US010738438B2

(12) United States Patent
McDonald

(10) Patent No.: US 10,738,438 B2
(45) Date of Patent: Aug. 11, 2020

(54) ATTACHMENT FOR A BUCKET OF A PRIME MOVER

(71) Applicant: Brian Cameron McDonald, Grenfell (CA)

(72) Inventor: Brian Cameron McDonald, Grenfell (CA)

( * ) Notice: Subject to any disclaimer, the term of this patent is extended or adjusted under 35 U.S.C. 154(b) by 0 days.

(21) Appl. No.: 16/244,436

(22) Filed: Jan. 10, 2019

(65) Prior Publication Data

US 2019/0257056 A1 Aug. 22, 2019

Related U.S. Application Data

(60) Provisional application No. 62/633,698, filed on Feb. 22, 2018.

(51) Int. Cl.
*E02F 3/34* (2006.01)

(52) U.S. Cl.
CPC ..... *E02F 3/3417* (2013.01); *Y10S 37/903* (2013.01); *Y10S 414/125* (2013.01)

(58) Field of Classification Search
CPC ..... E02F 3/3417; E02F 3/404; E02F 3/962; Y10S 37/903; Y10S 414/125
USPC ..... 414/724
See application file for complete search history.

(56) References Cited

U.S. PATENT DOCUMENTS 4,297,073 A * 10/1981 Schmid ..... E02F 3/404 414/704
4,307,992 A * 12/1981 Robnett ..... E02F 3/3604 172/828
4,781,518 A * 11/1988 Paavila ..... E02F 3/8155 172/777
5,618,155 A * 4/1997 Tighe ..... B60D 1/36 280/504
5,639,205 A * 6/1997 Kaczmarczyk ..... A01B 43/00 37/406
6,074,160 A * 6/2000 Brumbaugh ..... E02F 3/3609 37/903
7,654,551 B2 * 2/2010 Page ..... E02F 9/02 280/416.1
7,963,053 B1 * 6/2011 Courville ..... E02F 3/962 37/405
8,615,907 B2 * 12/2013 Miller ..... E02F 3/404 172/615
9,611,618 B2 * 4/2017 Miller ..... E02F 3/404

* cited by examiner

*Primary Examiner* — Michael S Lowe
(74) *Attorney, Agent, or Firm* — Christopher J. Dynowski; Ade & Company Inc.; Ryan W. Dupuis

(57) ABSTRACT

An attachment for use with a bucket of a prime mover comprises a base member having fixed shape in a longitudinal direction of the base member between first and second ends with first and second pivoting members pivotally connected at the first and second ends of the base member, each actuated for pivotal movement about a respective transverse axis by a distinct actuator. The second pivoting member forms a base for releasably receiving different attachment ends such as a secondary arm member carrying a respective pivoting member independently actuated of the base member's pivoting members that is disposed on a secondary arm member end distal to a connection end thereof for connecting to the base member, an extension member without any actuators and pivoting members, and a tool section which is designed for carrying out a specific function.

10 Claims, 22 Drawing Sheets

ATTACHMENT FOR A BUCKET OF A PRIME MOVER

This application claims the benefit under 35 U.S.C. 119(e) of U.S. Provisional Application Ser. No. 62/633,698 filed Feb. 22, 2018, which is incorporated by reference herein.

FIELD OF THE INVENTION

The present invention relates generally to attachments for buckets of prime movers such as skid steers and front end loaders, and more particularly to such attachments which comprise various ends attachable to a common type of base member which is mounted to the bucket. The base member supports a pivoting member at each end thereof, each of which is actuated by a distinct actuator for pivotal movement relative to the base member. Consequently orientations and positions of the various ends of the attachment can be manipulated relative to the bucket for carrying out various tasks. For example, one type of end can be a fork positioned substantially in a common plane with the bottom wall of the bucket so that the prime mover can be operated as a fork lift.

BACKGROUND

Various attachments for prime movers such as skid steers are known in the art, which cooperate with the bucket to perform various tasks. For example, an operator of the prime mover may wish to grasp brush, rocks, or debris, which can be raised and carried by the prime mover from one location to another in a manner being clamped between the bucket and the attachment movable relative thereto.

SUMMARY OF THE INVENTION

According to an aspect of the invention there is provided an attachment for use with a bucket of a prime mover, comprising:

a base member having fixed shape in a longitudinal direction of the base member between first and second ends;

first and second pivoting members at the first and second ends of the base member which are pivotally connected to the base member for pivotal movement relative thereto;

each of the first and second pivoting members being pivotally movable about a transverse axis which is transverse relative to the longitudinal direction of the base member;

an attachment arrangement on the first pivoting member for connecting to the bucket so as to mount the base member to the bucket, such that the base member is movable relative to the bucket; and first and second actuators carried on the base member that are operatively connected to the first and second pivoting members for actuating the pivotal movement thereof.

This arrangement provides a structure which has opposite ends that can be controlled for pivotal movement independently of one another so as to independently control orientation of the base member and orientation of a second portion of the attachment located in fixed relation to the second pivoting member pivotally carried on the base member.

In one arrangement the base member extends linearly from the first end thereof to the second end.

Typically the first and second actuators comprise hydraulic cylinders.

In one arrangement, rod ends of the hydraulic cylinders are pivotally connected to the first and second pivoting members.

In one arrangement the first and second actuators are disposed end to end on the base member.

Preferably the second pivoting member forms a base for releasably receiving different attachment ends.

Thus the second portion of the attachment as mentioned above may be a releasably attachable end which is connected to the second pivoting member.

One of the different attachment ends may comprise a secondary member with a connector end which is configured for connecting to the second pivoting member that is pivotally supported on the base member, the secondary member having fixed shape and comprising:

a respective pivoting member carried on the secondary member opposite the connector end; and an actuator carried on the secondary member that is operatively connected to the respective pivoting member for actuating the pivotal movement thereof.

One of the different attachment ends may comprise an extension member having a first end configured for connecting to the second pivoting member that is pivotally supported on the base member and an opposite second end which forms a base for releasably receiving an attachment end, the extension member extending linearly in a longitudinal direction of the extension member between the first and second ends each defining an interface plane which is transverse to the longitudinal direction, the interface plane of the second end being oriented non-perpendicular in a height direction of the extension member which is transverse to both a transverse direction and the longitudinal direction of the extension member so that said attachment end which is elongated and connected to the end of the extension member is oriented transversely to the longitudinal direction of the extension member.

One of the different attachment ends may comprise a tool member having a first connector portion configured for connecting to the second pivoting member that is pivotally supported on the base member, and a working portion forming a fork, the working portion comprising a pair of first prongs fixedly mounted to the first connector portion on one side thereof at transversely spaced locations on the first connector portion and a second prong pivotally mounted to the connector portion intermediate the first prongs to define a transversely oriented pivot axis of the second prong for movement relative to the first prongs, the second prong being operatively connected to an actuator operable to displace the second prong in pivotal movement relative to the first prongs which are stationary relative to the connector portion.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
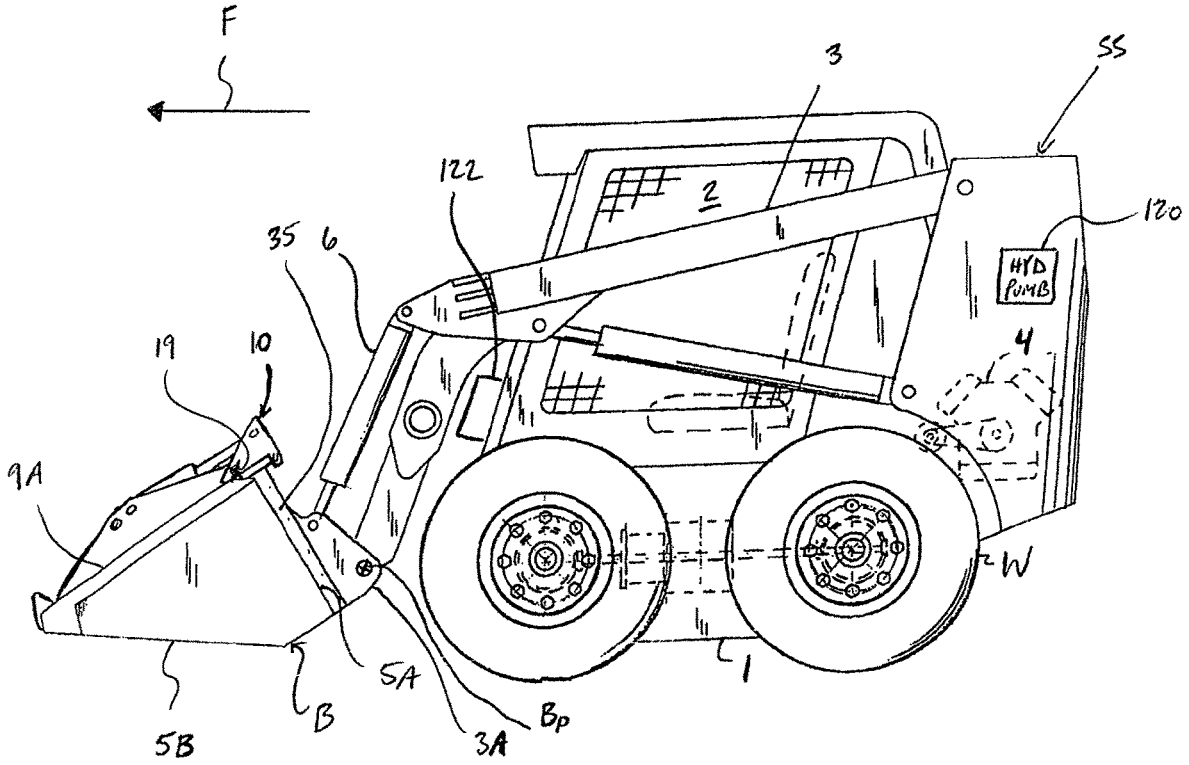
FIG. 1 is a side elevational view of skid steer, as one example of a prime mover with a bucket, and an arrangement of attachment according to the present invention can be used.

Referring to the accompanying figures, FIG. 1 shows a prime mover such as skid steer SS with an attachment 10 according to an arrangement of the present invention mounted to a bucket B of the skid steer for use therewith.

The conventional skid steer SS comprises a frame 1 carrying a plurality of wheels W rotatably supported on the frame for moving the frame of the skid steer across a support surface such as the ground in for example a forward working direction F which is perpendicular to rotational axes of the wheels W. The frame 1 supports an operator cabin 2 which houses controls of the skid steer loader, and on either side thereof is provided one of a pair of pivotal lift booms or arms 3 which are pivotally displaceable relative to the frame about a horizontal pivot axis located rearwardly of the cabin 2 where drive components including a motor 4 of the skid steer are also generally located. The bucket B comprising a rear wall 5A, a bottom wall 5B and laterally opposite side walls 5C and 5D is operatively coupled at front ends 3A of the lift booms 3 for example by a quick-attach style of coupling. Thus the bucket B can be raised and lowered relative to the frame 1 by pivotal movement of the arms 3 to lift and lower the front ends of the arms 3. The booms 3 also carry hydraulic cylinder actuators 6 which are operatively coupled to pivot the front ends 3A carrying one end of the quick-attach coupler about a horizontally oriented pivot axis $B_P$ located at and defined by the front ends 3A of the booms. As shown in FIG. 1, the bucket is generally supported at one end of the frame 1, and the bucket axis $B_P$ is transversely oriented to the forward working direction F.

The rear wall 5A of the bucket is located at a rear of the bottom wall 5B and stands upwardly therefrom to a top rear edge 7 spaced above an inside surface 8 of the bottom wall 5B. The side walls 5C and 5D bridge adjacent lateral sides of the rear and bottom walls 5A, 5B so as to form between the bucket walls a receptacle which can carry material. The bucket B also comprises a laterally extending cutting edge 9 carried at a front end of the bottom wall 5B. The cutting edge 9, top rear edge 7 and edges 9A of the side walls 5C, 5D which are adjacent thereto and span therebetween collectively delimit an opening of the bucket as more clearly shown in FIG. 2.

Figure 2:
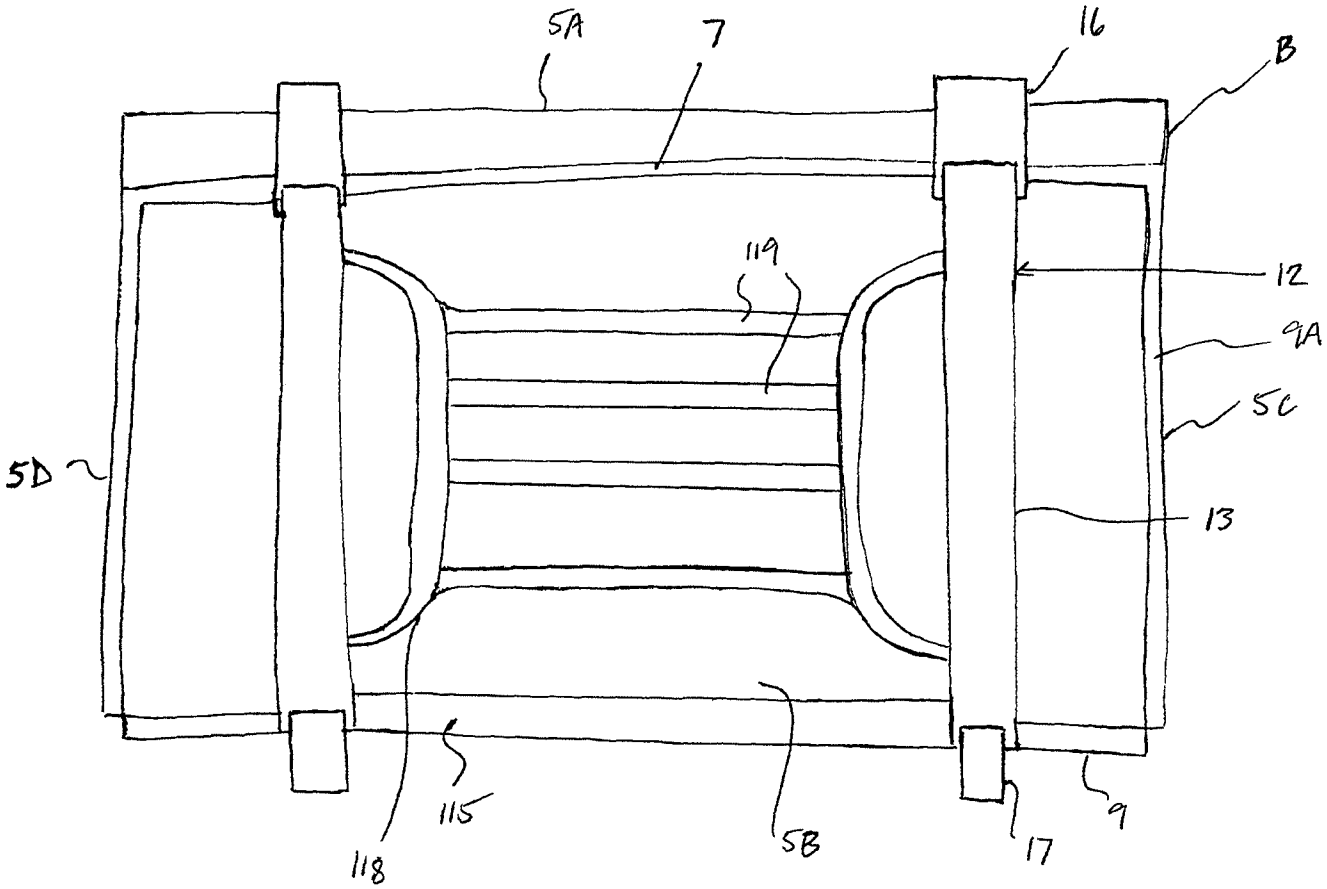
FIG. 2 is a front elevational view of the bucket and a base arm section of the arrangement of attachment in FIG. 1 with some components omitted for clarity of illustration.
Figure 3:
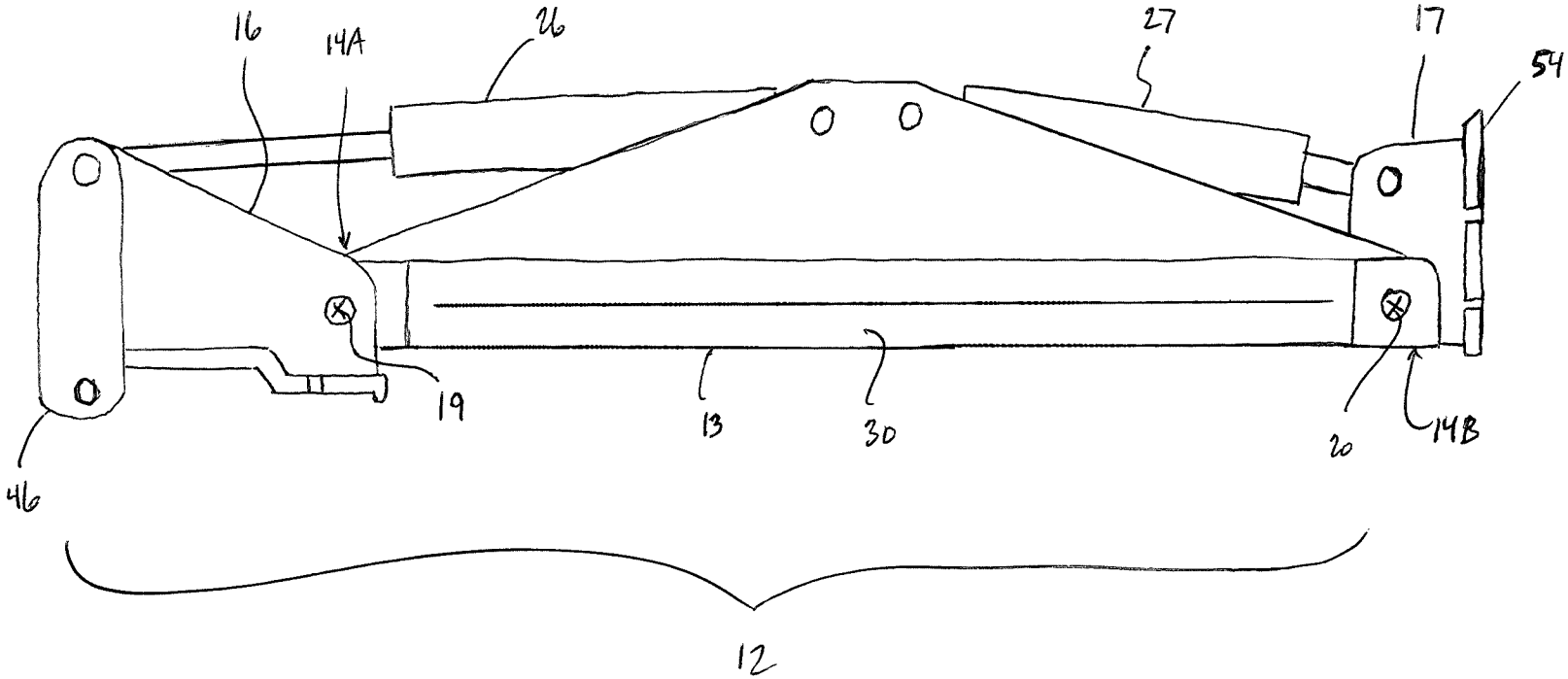
FIG. 3 is an elevational view of the base arm section of the arrangement of FIG. 1.
Figure 4:
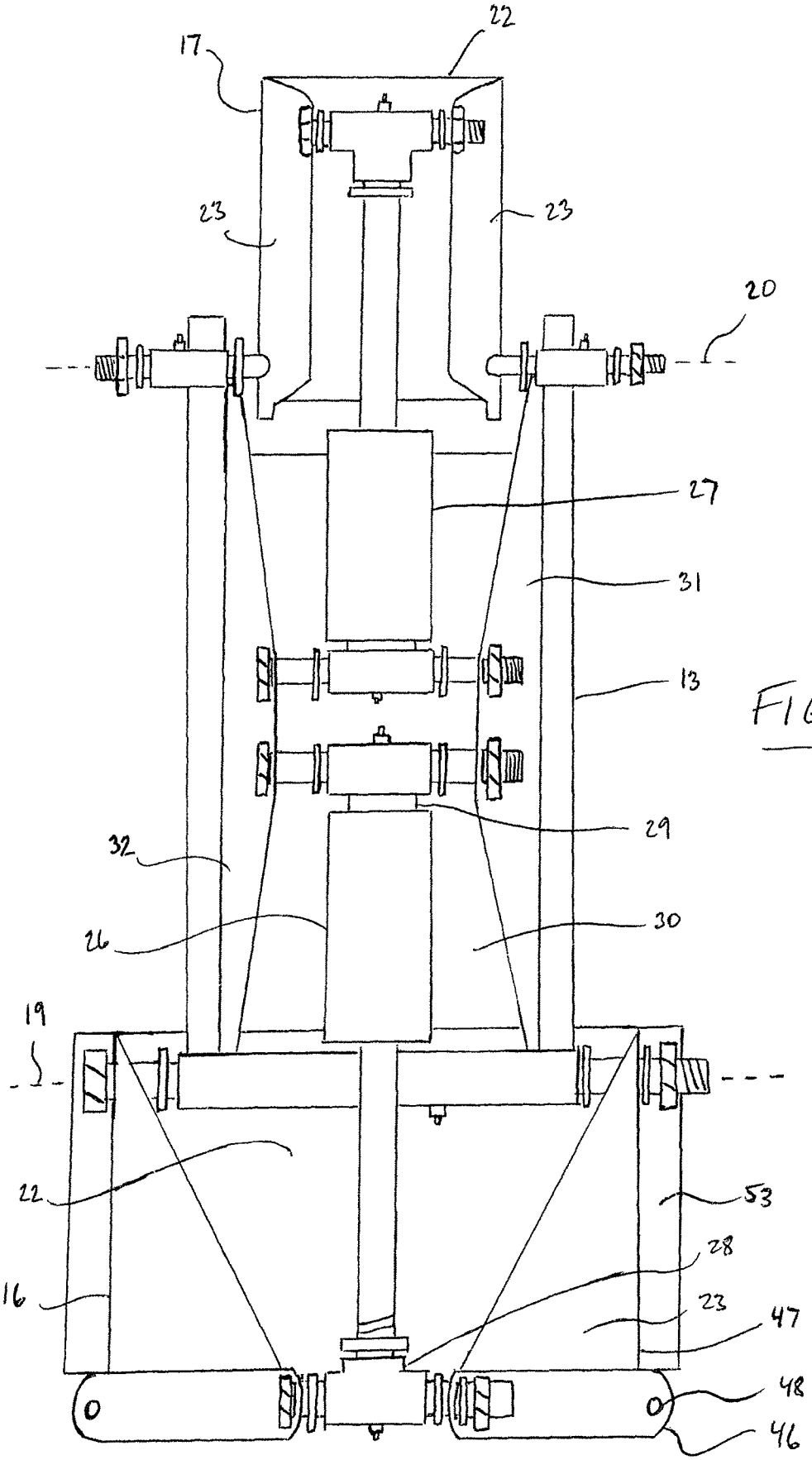
FIG. 4 is a top perspective view of the base arm section of the arrangement of FIG. 1.

The attachment 10 comprises a series of arm sections arranged in a prescribed order depending on the desired task to be fulfilled by the attachment, each section attached to the next with one end of the series mounted to the bucket as shown in FIGS. 1 and 2 and the other free end defining a working end of the attachment. Although there exist a number of configurations, each configuration can be formed using the types of arm sections described in further detail below.

Referring to FIGS. 3-6, each configuration of the attachment 10 includes a base arm section 12 which comprises a base member 13 having fixed shape in a longitudinal direction of the base member directed along the member from one end 14A thereof to an opposite end 14B. That is, the base member 13 is rigid from the first end 14A to the second end 14B such that there are no movable joints therealong such as no pivot points. The base member 13 of the illustrated embodiment extends linearly between its opposite ends 14A, 14B.

At each end 14A, 14B of base member 13 there is supported a pivoting member 16, 17 which is pivotally connected to the base member 13 for pivotal movement relative thereto about a horizontally oriented axis 19, 20 which is transverse to the base member. The transverse pivot axes 19, 20 of the pivoting members are parallel to one another and spaced longitudinally of one another along the base member.

Each of the pivoting members is formed of a base plate 22 oriented perpendicularly transversely of the longitudinal direction of the base member 13, with a pair of parallel upstanding ears 23 on either side of the plate 22 defining aligned apertures through which pins defining the transverse pivot axes are passed. The pivot axes 19, 20 of the base section's pivoting members 16, 17 are located in a common plane which is parallel to a longitudinal linear axis defined by the base member.

In order to drive pivotal movement of each pivoting member 16, 17 the base member 13 carries first and second hydraulic cylinder linear actuators 26 and 27 disposed end to end which are respectively operatively connected to the first and second pivoting members so that each pivoting member is driven in pivotal movement by a separate independently controllable actuator. A piston rod end 28 of each hydraulic cylinder 26, 27 is pivotally connected to the driveable pivoting member at a spaced location thereon from the respective pivot axis 19 or 20 formed between the pivoting member and the base member 13. A base end 29 of each hydraulic cylinder 26, 27 is carried by the base member 13 at a transversely oriented pivot pin so that the base end of the respective cylinder can pivot slightly relative to the base member as its piston rod extends or retracts relative to its base depending on the pivotal position of the respective pivoting member relative to the base member.

Thus the base member 13 is formed from a linearly extending beam 30 oriented in the longitudinal direction of the base member with upstanding flanges 31 and 32 disposed laterally on either side of the beam spanning the full length of the beam 30, so as to be generally H-shaped in cross-section. The upstanding support flanges 31, 32 each define a pair of apertures centrally of the respective flange in longitudinally spaced relation from one another and transversely aligned with the corresponding aperture of the opposite support flange. Each opposite pair of apertures on opposite support flanges receives the pin which interconnects one of the hydraulic cylinders with the base member. Thus the hydraulic cylinder 26, 27 are carried above the beam 30 in the space formed between the flanges 31, 32.

Figure 5:
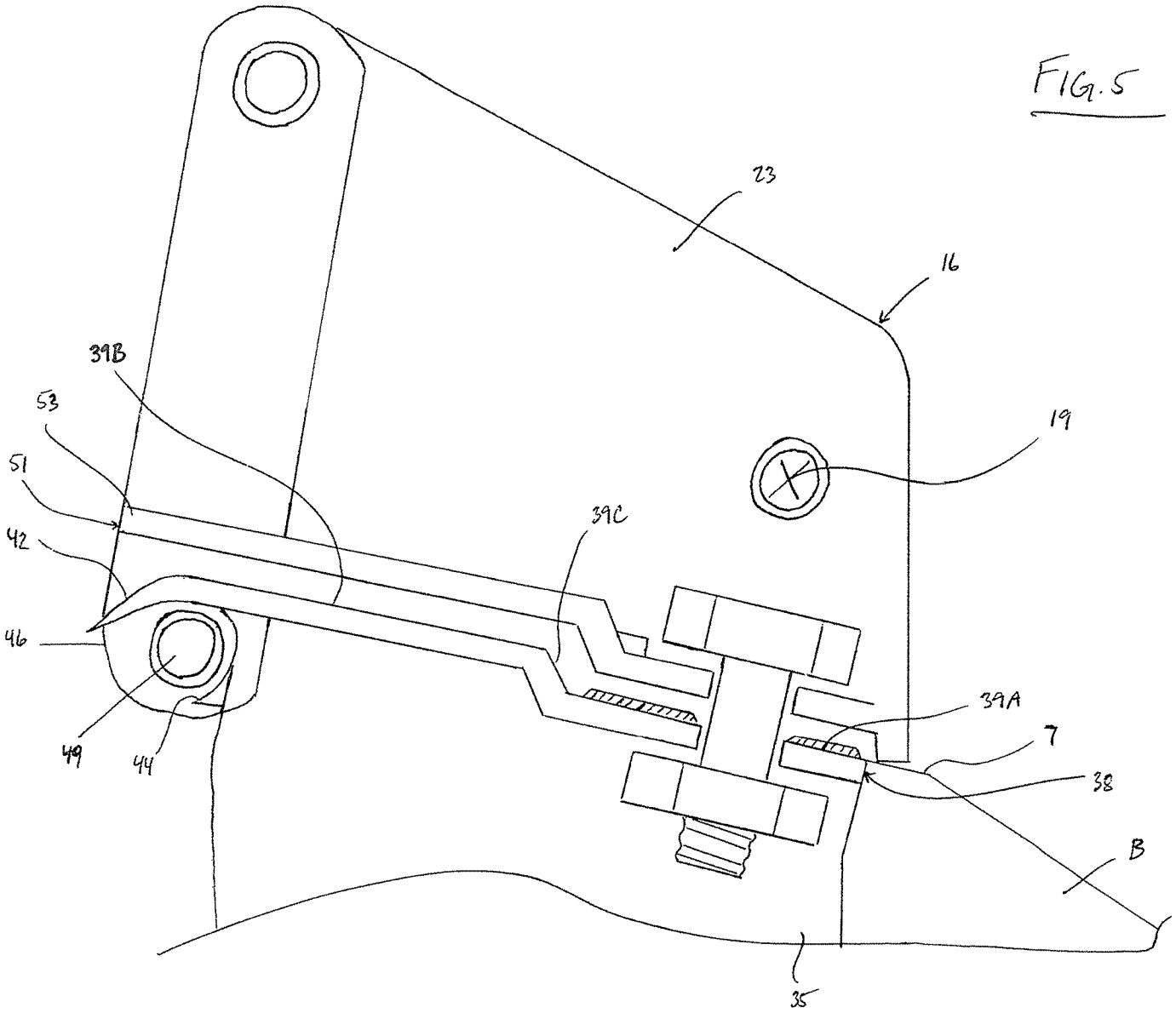
FIG. 5 is a side elevational view of a first pivoting member of the base arm section of FIG. 4.
Figure 6:
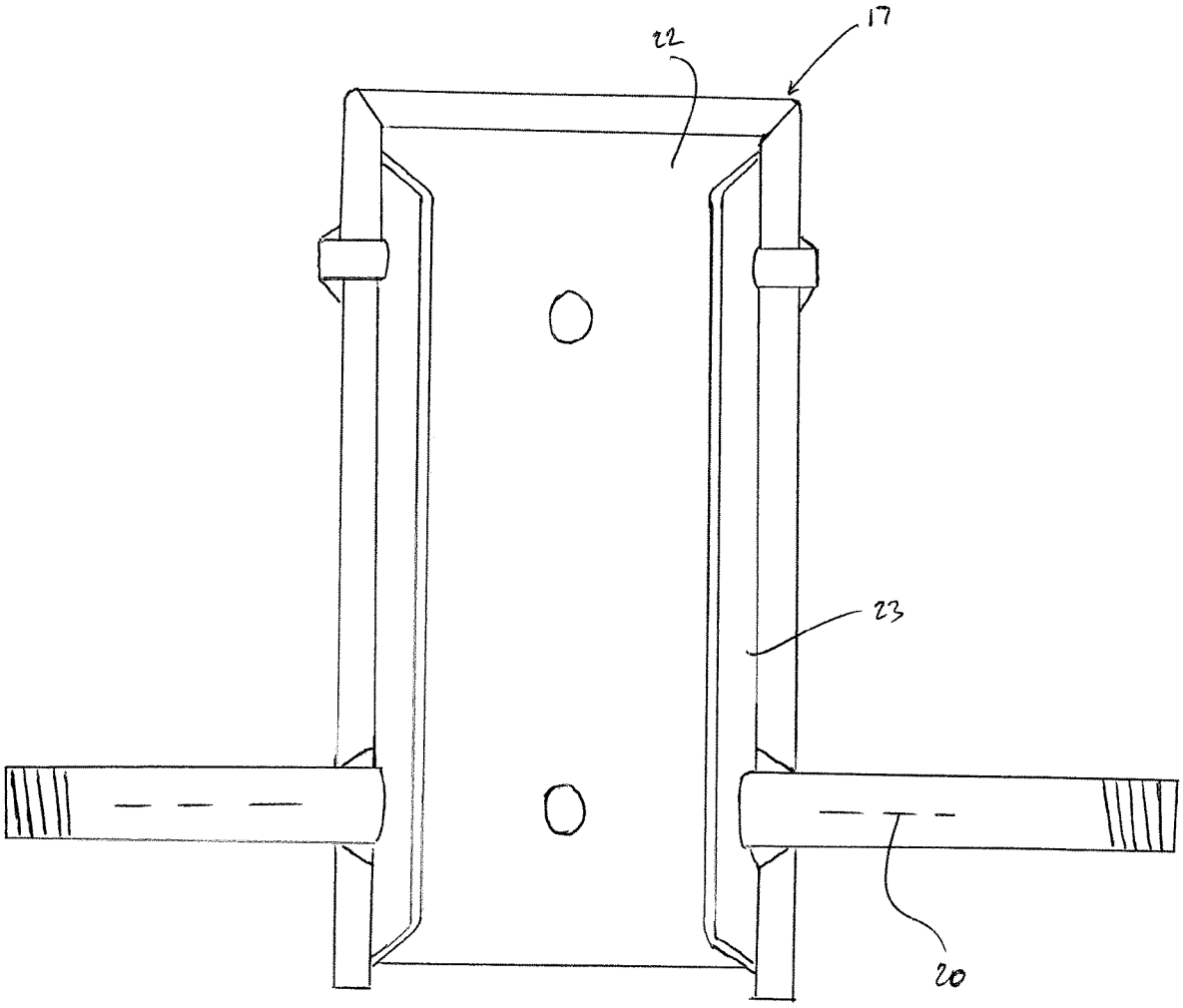
FIG. 6 is a rear perspective view of a second pivoting member of the base arm section of FIG. 4.

A first one of the pivoting members 16 supports an attachment arrangement in the form of a quick-attach style of coupling for connecting the base arm section to the bucket so as to mount the attachment 10 thereto. The conventional bucket B is adapted to include an attachment mounting portion comprising a rib 35 extending linearly across the rear wall 5A in a direction from a bottom to a top thereof, and terminating at the top edge 7 of the rear wall 5A where there is connected a mounting surface 38 which is generally normal to the rib 35 and the top edge 7 of the rear wall. The mounting surface 38 comprises two planar portions 39A and 39B each of defines a plane which is parallel and spaced from the next, with an angled portion 39C which is transversely inclined to both planar portions 39A and 39B. A front one of the planar portions of the mounting surface indicated at 39A overlaps the top edge 7 of the rear bucket wall 5A. The angled portion 39C is located at a rear of the front planar portion 39A and is inclined upwardly and rearwardly therefrom. At a top of the angled portion 39C is provided the rear planar portion 39B which extends rearwardly therefrom, in a plane parallel to the front planar portion 39A. At a rear of the rear planar portion 39B is formed a hook 42 which curves rearwardly and downwardly, and whose top face is contiguous with the mounting surface at the rear planar portion 39B. Diametrically opposite an arcuate path followed by the hook 42 there is provided a concave shaped support surface 44 such that an inner side of the hook and the concave support surface collectively define a horizontally extending circular cylindrical void suitable for receiving a pin. As shown in FIGS. 1 and 5, the first pivoting member 16 is disposed adjacent the top edge 7 of the bucket B with the pivot axis 19 of the first pivoting member 16 disposed generally parallel to the bucket axis $B_P$ at a spaced location therefrom.

The first pivoting member 16, which is on a proximal end of the base member 13 in relation to the bucket B, includes, in addition to those elements described earlier in relation to both pivoting members 16 and 17, a depending portion 46 extending past bottom edges 47 of the parallel ears 23 so as to form a tab where there is defined a pin aperture 48 which is horizontally linearly aligned with the corresponding aperture of the opposite tab for receiving a pin 49. This pin 49 is received in the pin-receiving void defined by the hook 42 and opposite cooperating concave surface 44 of the attachment mounting portion connected to the bucket.

With the actuator-receiving openings defined closer to a top of the proximal pivoting member 16 than to a bottom thereof, the bottom of the proximal pivoting member 16 which is adapted for joining the mounting surface 38 thus also comprises a mating surface 51 with a corresponding set of constituent surfaces matching the mounting surface 38 so as to mate in flush alignment therewith. The mating surface 51 of the first pivoting member is formed on laterally outwardly extending flanges 53 which are oriented perpendicular to the respective ear 23 to which each is attached and also longitudinally of the proximal pivoting member, corresponding to a general direction in which the aperture carrying the pivot pin and the aperture carrying the end of the actuator are spaced along the respective ear. Thus when the mating surface 51 and the mounting surface 38 permanently connected to the bucket are abutted there remains an area to one side of the ear 23 for passing a fastener through aligned apertures defined in the abutted surfaces so as to securely clamp the proximal pivoting member to the mounting portion for the attachment on the bucket, thus mounting the attachment at the base arm section to the bucket B.

In order to facilitate the coupling as described in the previous paragraph, when the attachment 10 is initially decoupled from the bucket, the bucket is tilted downwardly about the bucket pivot axis $B_P$ as if to arrange the top edge 7 of the rear wall vertically above the cutting edge 9. The bucket B is then positioned so that the cylindrical void defined between 42 and 44 on the mounting portion is brought into suitable alignment with the openings 48 located in the tabs of the proximal pivoting member, and the pin 49 is passed through the now registered void and apertures so as to interconnect the attachment 10 and the bucket B. The bucket B is then tilted upwardly about axis $B_P$ so as to raise the cutting edge 9 and lower the top rear edge 7 in relation to one another, causing the mounting surface 38 and the mating surface 51 to be disposed in butting engagement. The inclined portions of both surfaces 38 and 51 act to guide the whole of the surfaces 38, 51 into flush alignment with one another and so that the apertures on opposite surfaces receiving the clamping fastener are registered with one another, given that it is by pivotal movement of the bucket in relation to the attachment (still not secured to the bucket) about an axis defined by pin 49 that the surfaces are mated.

The openings/apertures defined in the proximal pivoting member 16 of the base arm section are arranged in triangulated relation forming an acute-angled triangle. With respect to the proximal pivoting member 16, both the pin receiving aperture 48 and those whereat the piston rod end 28 of the actuators 26, 27 is received are disposed in longitudinally spaced relation from the apertures whereat the pivot axis 19 or 20 of the respective pivoting member 16, 17 is defined. Also, the location on the proximal pivoting member 16 where the piston rod end 28 is connected and the pin receiving aperture 48 are disposed in transversely spaced relation on the pivoting member 16.

Turning now to the second pivoting member 17, which is arranged at a distal end of the base member 13 in relation to the bucket B, this supports on its front side opposite a rear side, from which the piston rod of hydraulic cylinder 27 extends back to the base member 13, a coupling arrangement 54 in the form of a quick-attach style of coupling so as to be enabled to releasably receive a corresponding face of another arm section which can define one of a number of different attachment ends. Thus the distal pivoting member 17 forms a base for releasably receiving different attachment ends.

One of the different attachment ends which is releasably attachable to the proximal end of the base arm section 12 is a secondary actuated arm section 57 having a corresponding secondary member 58 which is linearly elongated in a respective longitudinal direction from one end 58A thereof to the other indicated at 58B. The secondary member 58 also is rigid so as to have fixed shape in the longitudinal direction of the secondary member from a proximal one of the ends 58A (in relation to the base arm section) to a distal one of the ends 58B.

Figure 7:
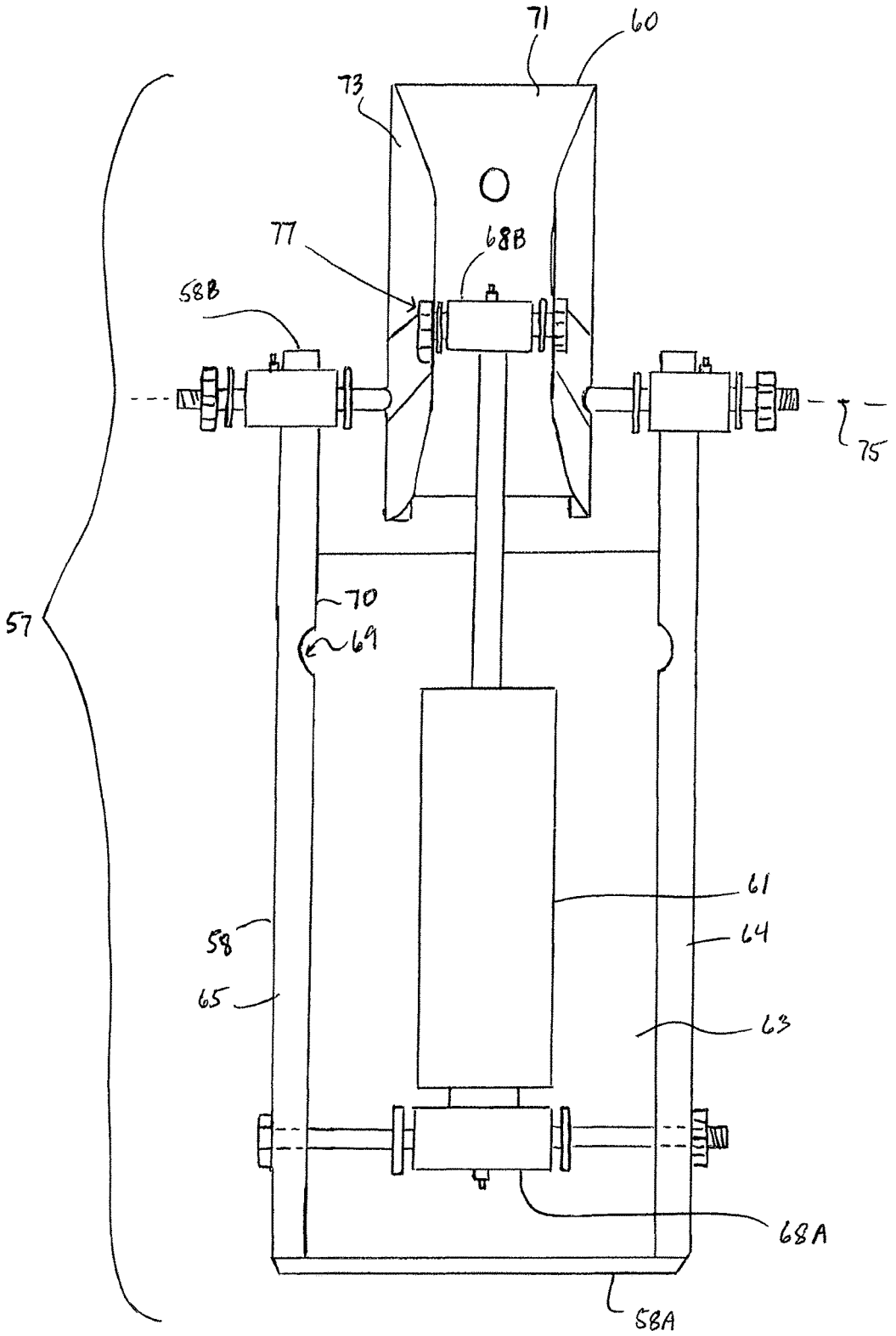
FIG. 7 is a top perspective view of a secondary arm section of the arrangement of FIG. 1.
Figure 8:
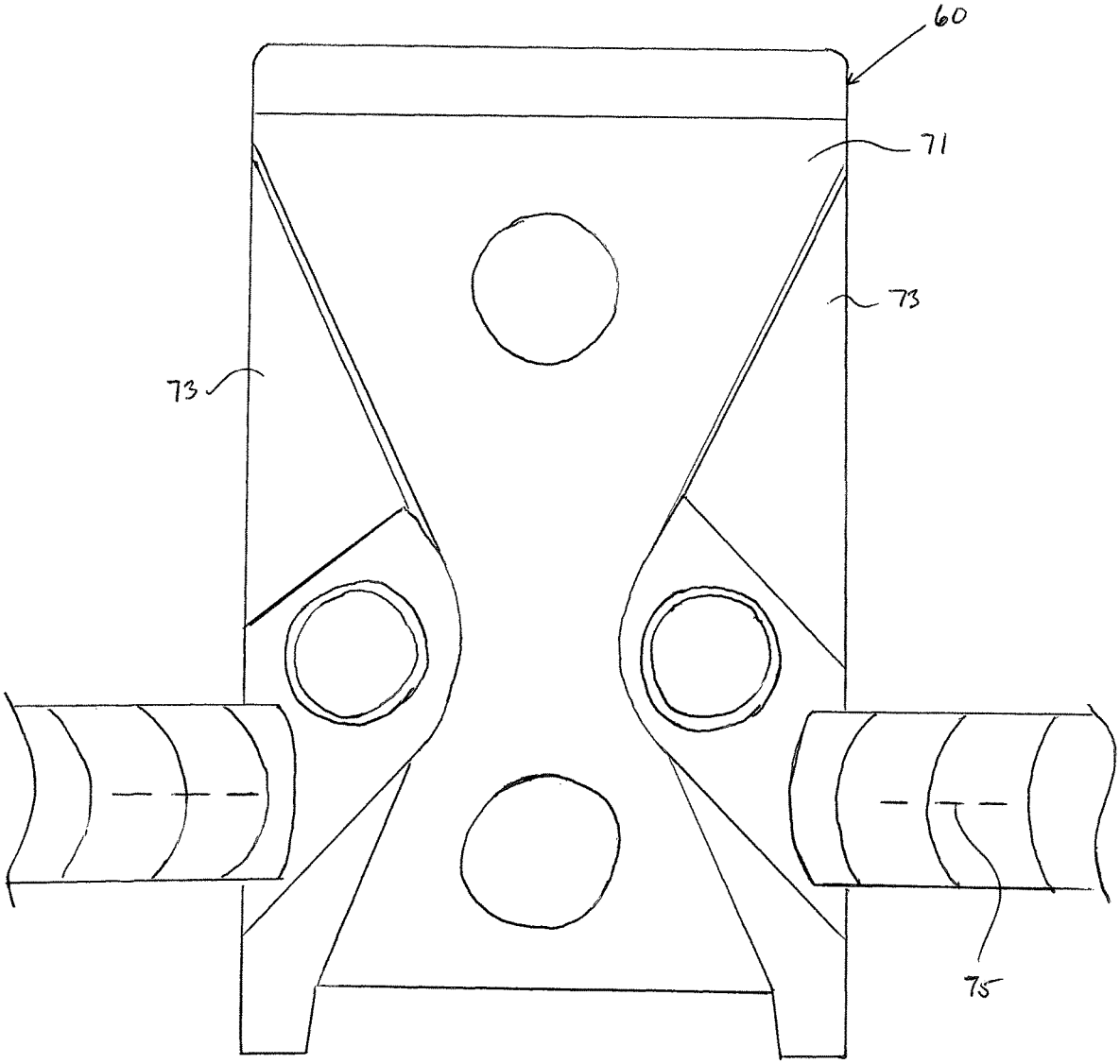
FIG. 8 is a rear perspective view of a pivoting member of the secondary arm section of FIG. 7.
Figure 9:
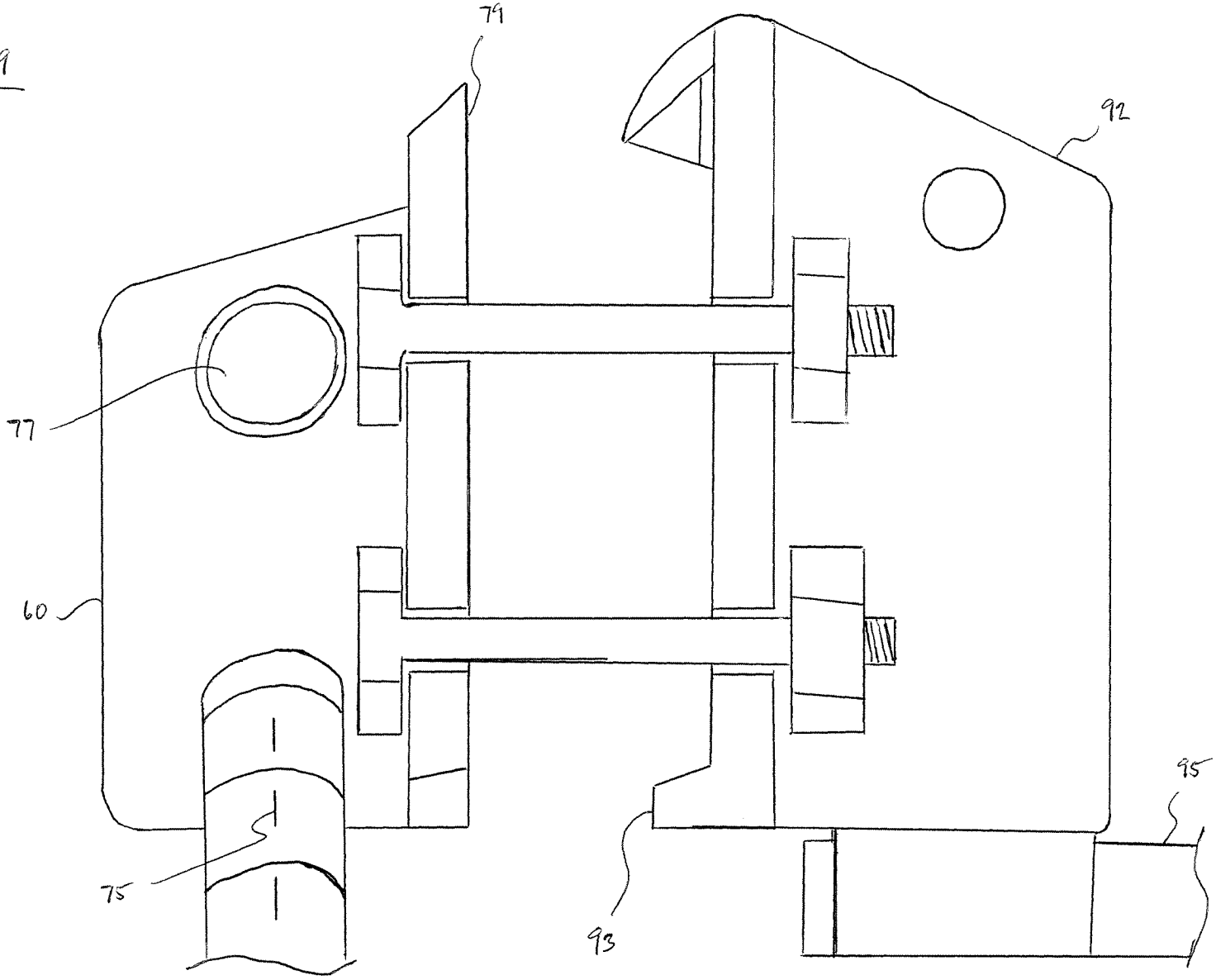
FIG. 9 is an enlarged side elevational view showing the pivoting member of the secondary arm section of FIG. 7 and another arm section of the arrangement of attachment of FIG. 1.

Referring to FIGS. 7-9, the secondary arm section 57 is similar in structure to the base arm section 12 except that it has only one pivoting member 60 disposed at the distal end 58B of the secondary member 58 and accordingly only one hydraulic cylinder linear actuator 61 operatively connected to the pivoting member 60 for controlling pivotal movement of same relative to the secondary member 58. Thus, as in the case of the base member 13, the secondary member portion 58 is formed from a linearly extending longitudinally elongated beam 63 with upstanding support flanges 64, 65 disposed laterally on either side of the beam. The support flanges 64, 65 span substantially the full length of the beam and define therebetween above the beam 63 a space for carrying the hydraulic cylinder 61.

A base end 68A of the cylinder 61 is pivotally connected at or adjacent the proximal end 58A of the secondary member so that the base end 68A can pivot slightly above a horizontally perpendicularly transversely oriented pivot axis defined by the base end, in relation to a longitudinal axis of the secondary member defined by the beam 63, during extension and retraction of the cylinder piston rod. A piston rod end 68B of the cylinder 61 is connected to the secondary arm section's pivoting member 60. Each of the support flanges includes a cut-out 69 defined in an upper edge 70 thereof spaced above the beam 63 which may provide clearance for pivotal movement of the piston rod end 68B when the hydraulic cylinder 61 is fully or nearly fully retracted.

The pivoting member 60 comprises a similar structure to the pivoting members 16, 17 in that it is formed from a base plate 71 oriented perpendicularly transversely of the longitudinal direction of the secondary member 58, with a pair of parallel upstanding ears 73 on either side of the plate 71 defining aligned apertures through which pins defining a transverse pivot axis 75 of the respective pivoting member 60 are passed.

The rod end 69 of the actuator 61 is pivotally connected to the pivoting member 60 at a spaced location from the pivot axis 75 thereof. More specifically, when the linear actuator is disposed so that its axis of actuation is parallel to the longitudinal axis of the secondary member beam 63 with the piston rod substantially retracted, a pivotal connection 77 of the rod end 69 to the pivoting member 60 is located at a longitudinally inwardly spaced location. In this condition of the actuator a planar mounting surface 79 provided by the pivoting member, which like the pivoting member 17 of the base arm section forms a base for releasably receiving another attachment end, is oriented normal to the longitudinal axis of the beam 63. Thus a range of pivotal movement of the pivoting member 60 and any subsequent arm section connected thereto is greater than if in the aforementioned condition of the cylinder actuator 61 the pivotal connection 77 and the pivot axis 75 lied in a plane parallel to the planar mounting surface 79 of the secondary arm section pivoting member 60.

The proximal end 58A of the secondary member 58 defined by an end of the beam 63 and support flanges 64, 65 forms a connector end of the secondary arm section supporting a cooperating and mating quick-attach style of coupling for connecting to the coupling arrangement 54 carried on the distal pivoting member 17 of the base arm section 12. Thus a pivotal orientation of the secondary arm section relative to the base arm section about a horizontal perpendicularly transverse or lateral axis is controlled solely by the pivotal orientation of the distal pivoting member 17. The connector end of the secondary arm section 57 defines a planar mating surface which is oriented normal to a horizontally and longitudinally oriented plane containing the pivot axis 75 of the secondary arm section's pivoting member 60.

Figure 10:
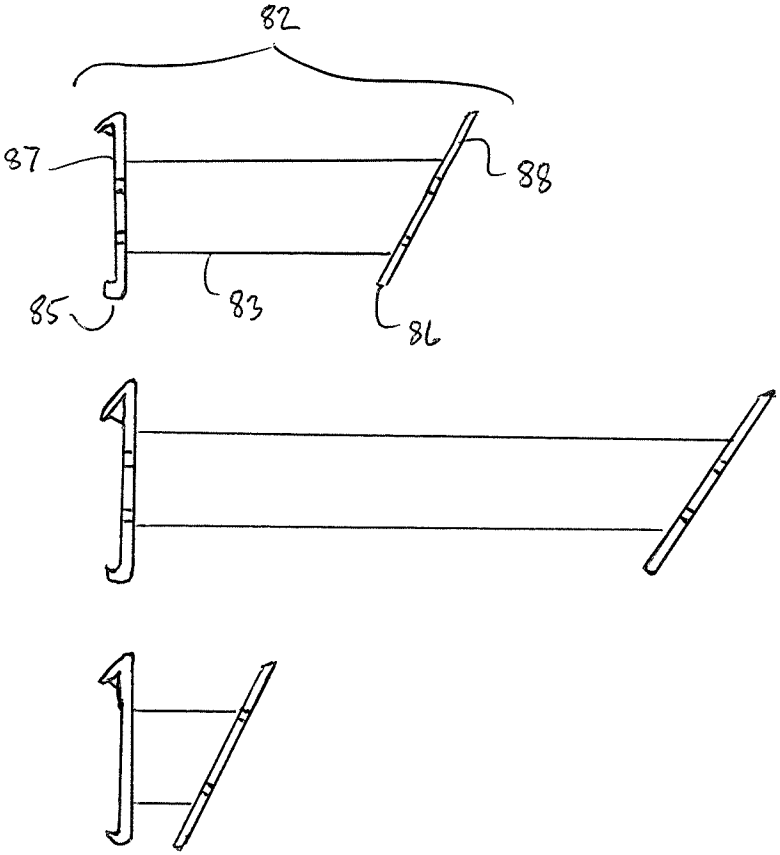
FIG. 10 illustrates an extension arm section of the arrangement of attachment of FIG. 1, where several example lengths of an extension member of this section are shown.

Referring to FIG. 10, another one of the different attachment ends which can be attached to the distal end of the secondary arm section or to the base arm section comprises an extension arm section 82 without any actuators or pivoting components having an extension member 83 with first and second connector ends 85, 86 each carrying a quick-attach style coupling arrangement 87, 88 for releasably connecting to another arm section. The extension member 83 is linearly elongated in a respective longitudinal direction of the extension member between the first and second connector ends 85, 86. The member 83 is rigid and has fixed linear shape between its opposite ends. The coupling arrangement 87, 88 of each connector end 85, 86 has a planar mating surface defining an interface plane which is perpendicularly transverse to the longitudinal direction of the extension member so as to cross the longitudinal direction at right angles in a lateral direction of the extension member. In particular, the second connector end 86 suited for receiving an attachment end of a tool type (i.e. which is designed so as to carry out a specific task) and not the base arm section nor the secondary arm section is configured so that its interface plane is further oriented non-perpendicular to a height direction of the extension member, which is perpendicularly transverse to both the longitudinal and the lateral directions, so that the attachment end connected to the distal connector end 86 which is elongated is oriented transversely to the longitudinal direction of the extension member. Thus the extension arm section 82 simply acts as a spacer providing a rigid bridge between two different sections interconnected by the extension arm section and introduces a transition in pivotal orientation relative to a horizontal transverse axis from the first to the second connector end.

Yet another one of the attachment ends comprises a tool section 90 which is designed to carry out a specific function, while the previously described types of arm sections such as the base arm section 12, secondary arm section 57 and extension arm section 82 are provided for manipulating position and orientation of the tool section 90 relative to the bucket B. The tool section comprises a first connector portion 92 supporting a coupling arrangement 93 of the quick-attach style of coupling for connecting to an end of a positioning type of arm section, and a tool or working portion 95 which is configured for carrying out the specific task of the tool section, for example, the tool portion comprises a fork so that the prime mover with the attachment coupled thereto can be operated as a fork lift.

Figure 12D:
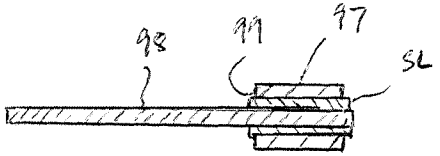
FIGS. 12C and 12D illustrate an end view and a cross-sectional view along line D-D in FIG. 12C of a second manner of attaching prongs of the variations of the first embodiment of tool section of FIG. 11.
Figure 12B:
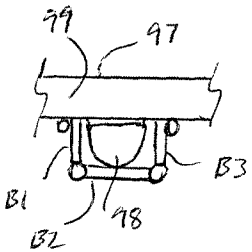
FIGS. 12A and 12B illustrate end views, one of which is a close-up view, of a first manner of attaching prongs of the variations of the first embodiment of tool section of FIG. 11.
Figure 12C:
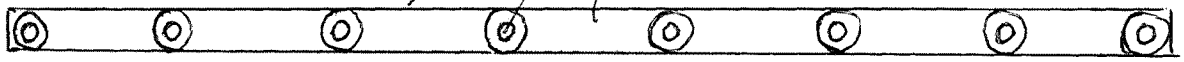
Figure 12A:
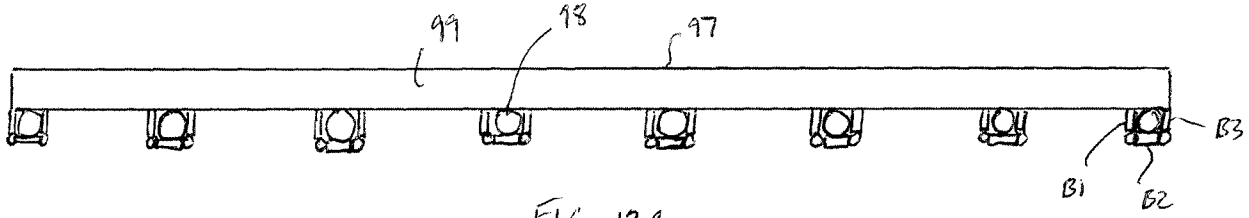
Figure 13:
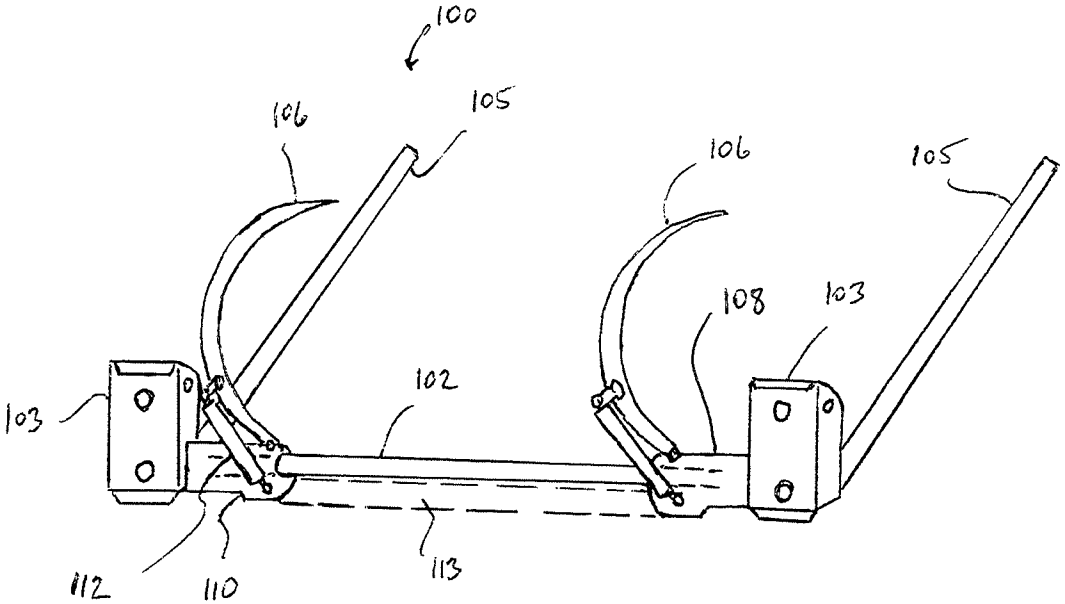
FIG. 13 is a rear perspective view of a second embodiment of tool section of the arrangement of attachment of FIG. 1.

Two arrangements of tool section forming a fork are illustrated in FIGS. 11-13. In a first arrangement in FIGS.

Figure 11A:
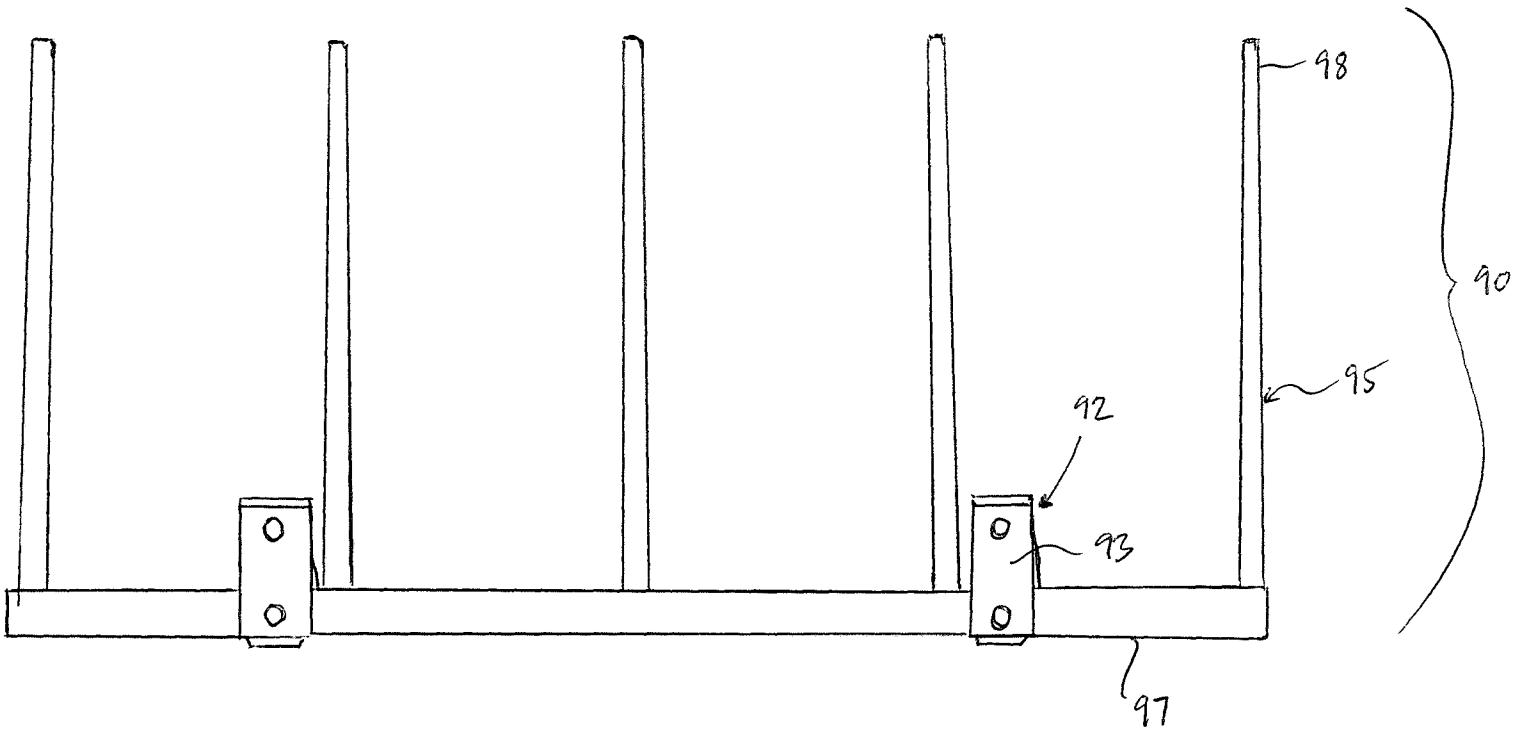
FIGS. 11A and 11B are rear perspective views of variations of a first embodiment of tool section of the arrangement of attachment of FIG. 1.
Figure 11B:
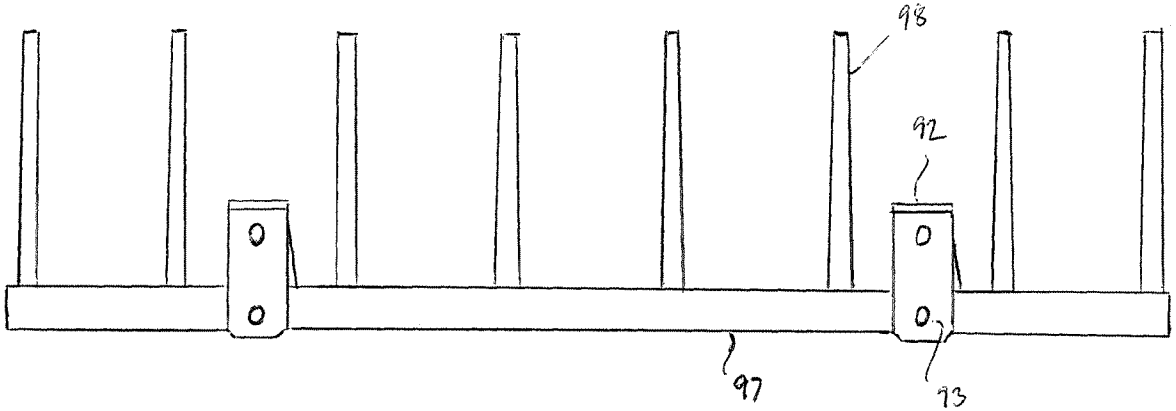

11-12 each showing a slight variation of a common design, the working portion 95 comprises a laterally extending main beam 97 with a plurality of longitudinally elongated prongs 98 at laterally spaced positions on a front side 99 of the beam 97, opposite where the connector portion 92 mounts to the next adjacent arm section to the rear of the tool section. The prongs 98 extend forwardly from the beam 97 so as to project in a longitudinally forward direction therefrom. The plurality of spaced prongs define one type of fork-like tool section 90. As shown in FIG. 11A a first variation of the first embodiment of tool section 90 has a fewer number of prongs which are longer in length, for example 32 inches in length, and in comparison, a second variation of FIG. 11B comprises a larger number of shorter prongs which are for example 16 inches in length. FIGS. 12A and 12B show that the prongs can be attached to the beam 97 in butting engagement with an underside of the beam, being held in abutment therewith by a bracket encompassing a remainder of a circumference or transverse periphery of the prongs which is not in contact with the beam 97. As more clearly shown in FIG. 12B the bracket is formed by a series of brackets B1 through B3 welded (shown schematically by circular joints) each beside the next so as to form a U-shaped bracket. Alternatively, as shown in FIGS. 12C and 12D the prongs may be embedded in receptacles formed in the front side 99 of the beam 97. Tubular sleeves SL receiving the prongs act to interconnect the prongs and the beam in which the sleeves are received.

In a second arrangement 100 of tool section as shown in FIG. 13 the working portion thereof comprises a beam 102 extending laterally between opposite couplers 103 of the quick attach variety of the connector portion 92 (as will be better appreciated shortly), and at each one of the couplers 103 there is mounted a single projecting linear prong 105 extending longitudinally forwardly of the couplers 103. On a laterally inner side of each coupler there is mounted to the cross beam 102 a curved prong 106 which is curved upwardly in a height direction and longitudinally forwardly in a common direction as that in which the linear prongs 105 project from the couplers 103. The curved prong 106 is pivotally supported in front of the beam 102 on a sleeve 108 received over the cross beam 102 in a coaxial relation. The sleeve has a cantilevered portion 110 on a rear of the cross beam 102 which pivotally supports a base end of a hydraulic cylinder linear actuator 112 operatively connected at its opposite piston rod end to the curved prong 106. Thus actuation of the hydraulic cylinder 112 acts to pivot the curved prong 106 about a lateral axis substantially parallel to the cross beam so as to cause the free end of the prong 106 to approach or be displaced away from a common plane containing both the cross beam 102 and the linear prongs 105. The second embodiment 100 may additionally include an auxiliary cross beam 113 (shown in phantom in FIG. 13) extending between the couplers 103. As illustrated and described above the second arrangement 100 of tool section can be used as a grapple to confine an object between the actuatable curved prongs 106 and the linear prongs 105.

Figure 14:
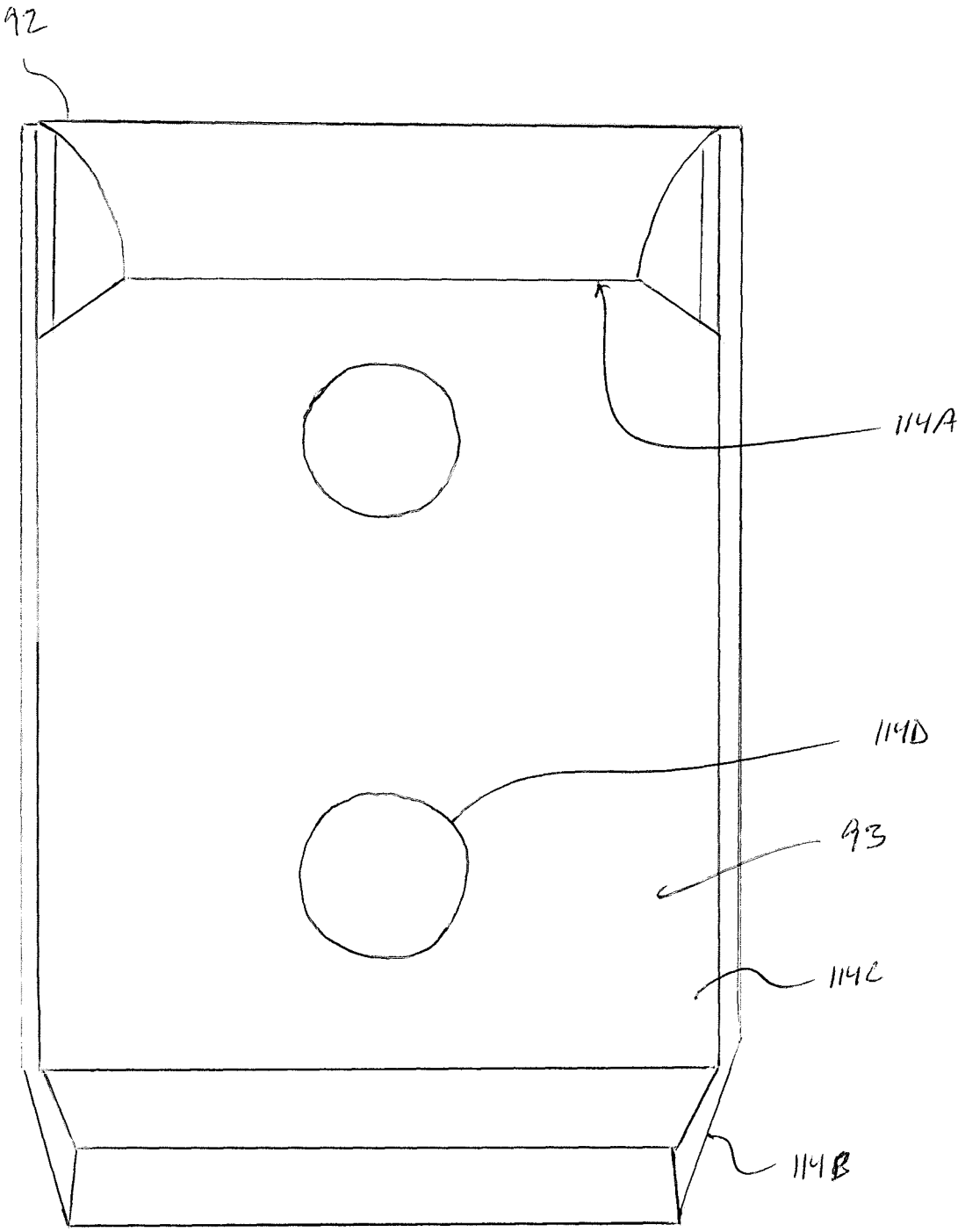
FIG. 14 is a rear perspective view of a connector portion of the tool section of the arrangement of FIG. 1.

FIG. 14 more clearly shows the connector portion 92 with the quick-attach style of coupling 93 which includes a top receptacle 114A defining a generally downwardly-facing opening to receive a top end of the pivoting member which mates therewith. The coupling 93 also provides a bottom cupping portion 114B which is raised above a planar mating surface 114C defined by the coupling 93 so as to act as a stop against movement of the mating pivoting member out of the receptacle 114A. Additionally, centrally located holes 114D are provided in the backside of the coupling 93 for passing fasteners such as bolts through the coupling 93 and the mating pivoting member to secure them together.

In the illustrated arrangement of attachment 10 each of the aforedescribed positioning sections is provided with the constituent members in pairs so that, for example, the base arm section 12 comprises a pair of the base members 13 arranged in transversely spaced relation to one another, which increases a width of the attachment 10 for carrying out its various functions. However, in some arrangements there may be only one of each constituent member forming a respective section of the attachment, in which instance for example the respective single constituent member may be thickened in size, particularly in width, so as to be sufficiently strong to bear weight of sections connected to same. It will be appreciated that as the positioning sections comprise pairs of the constituent members, the linear actuators on each opposing member of the respective pair are aligned with those of the other member of the pair to ensure each positioning section maintains a uniform elevation above the bucket across the full width of the respective positioning section. Thus, piston rods of the hydraulic cylinder linear actuators have adjustable length provided by adjustable rod ends 28 which are threadably axially displaceable along the rods so that the linear actuators may be aligned.

Figure 15:
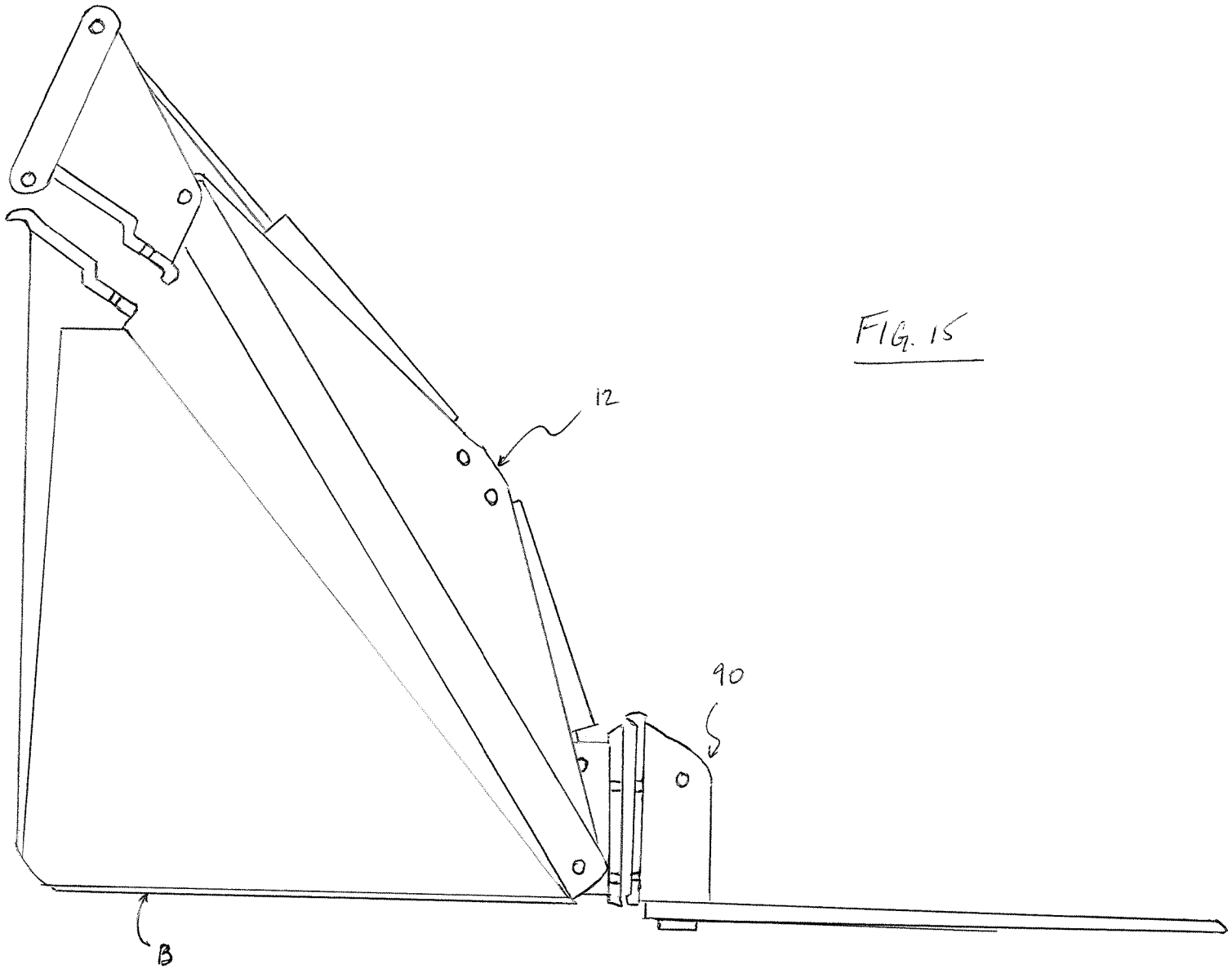
FIG. 15 is an elevational view of one configuration of the arrangement of attachment of FIG. 1.

Referring to FIG. 2, typically the base member 13 is sized in length so as to be substantially equal to a distance from the top rear edge 7 to the cutting edge 9 along tops of the side walls 5C, 5D so that the distal pivoting member 17 can be positioned at a height of the cutting edge 9 and generally in front thereof with the tool section 90 of the fork variety extending therefrom in a plane parallel to the bottom wall 5B of the bucket B as shown in FIG. 15.

Furthermore, the base arm section 12 includes at least one cross member 115 extending in the perpendicularly transverse direction between the pair of the base members 13. This cross member 115 is connected to the base members at a location which is at or adjacent the distal pivoting members 17 of the base arm section so that when the distal end of the base arm section is brought to touch with the cutting edge 9 of the bucket B the cross member 115 cooperates with the cutting edge 9 as a clamp to hold material such as brush in a space between the base arm section 12 and the bucket B. The at least one cross member spanning laterally between base members 13 of the base arm section may also include an array 118 of longitudinally spaced laterally extending bars 119 mounted to the base members 13. Thus is provided on a underside of the array 118 facing the interior of the bucket B a larger surface which is laterally intermediate the base members 13 to the rear of the cross member 115 alignable with the cutting edge 9 and in front of the top rear edge 7 of the bucket, which can act to clamp material contained within a volume of the bucket delimited by its walls 5A-5D.

Each of the hydraulic cylinder linear actuators of the attachment 10 are respectively operatively connected to hydraulic pumps 120 (schematically shown) of the prime mover for driving each actuator individually of the others. For example, all of the hydraulic actuators can be connected to a multi-way control valve 122 which further connects to the hydraulic pumps so that a common set of hydraulic pumps 120 can be selectively used to drive designated ones of the actuators depending on a user-selected setting of the control valve 122 for actuating one attachment section or a portion of a respective attachment section.

The attachment 10 of the arrangement of the present invention provides a versatile attachment for use with the bucket B of a prime mover which can be reconfigured depending on intended use and whose various sections when connected in the order of bucket B—base arm section 12—secondary arm section 57—optionally extension section 82—tool section 90, mimic motion of a finger of a human hand so as to enhance a reach of the attachment 10 outwardly from the bucket B so as to grasp and bring material into the bucket.

Figure 16:
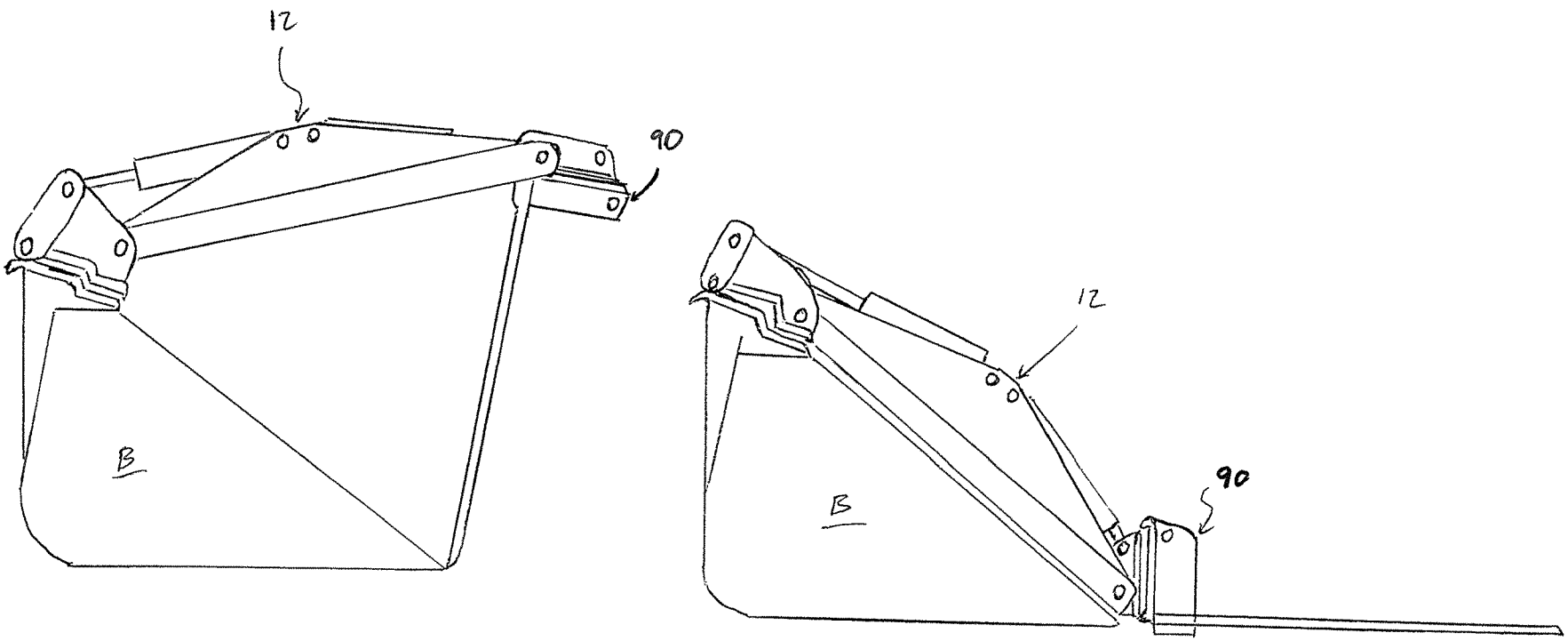
FIG. 16 is an elevational view of the configuration of FIG. 15 arranged in a different position relative to the bucket.
Figure 17:
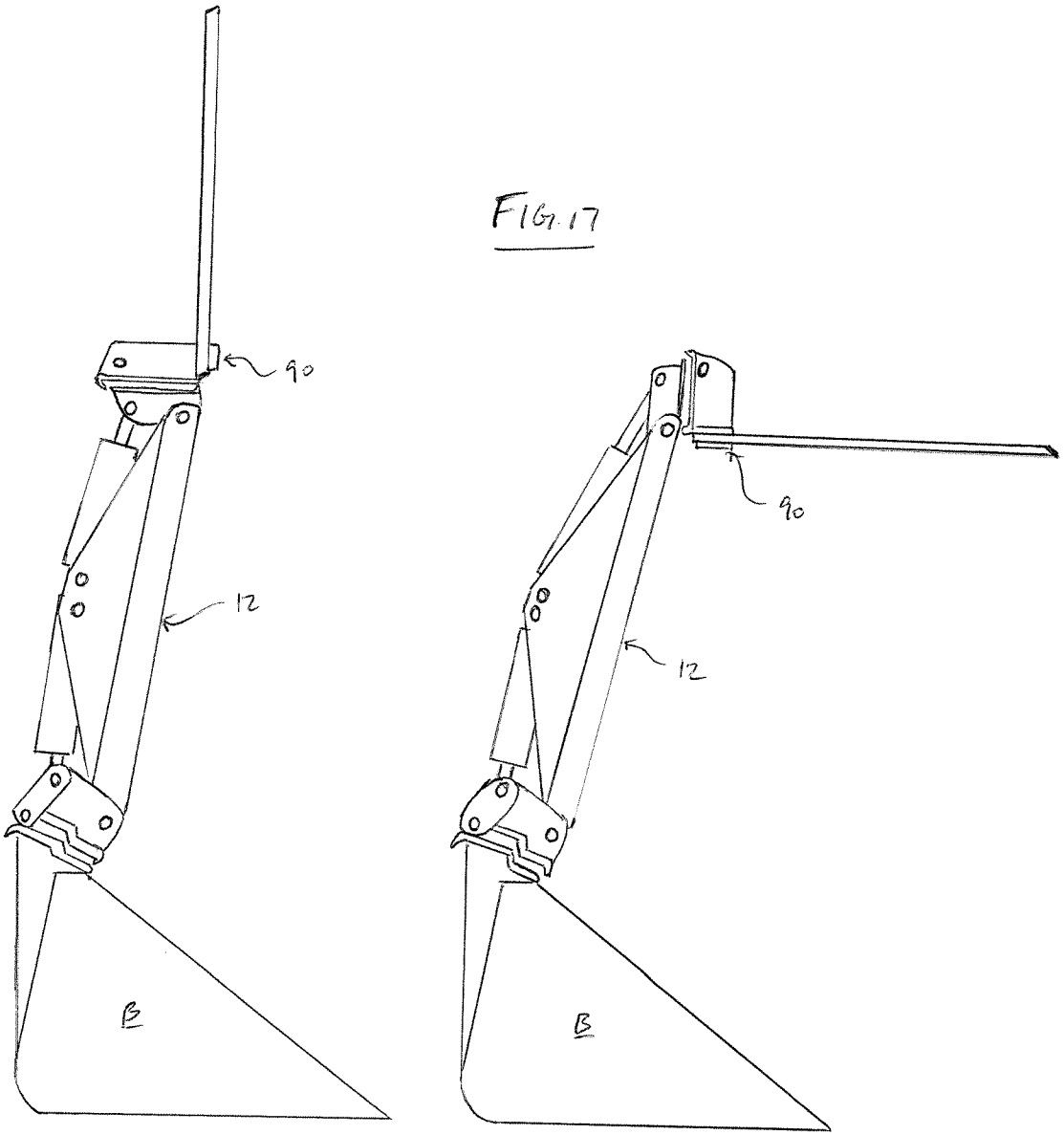
FIG. 17 is an elevational view of the configuration of FIG. 15 arranged in a yet different position relative to the bucket.
Figure 18:
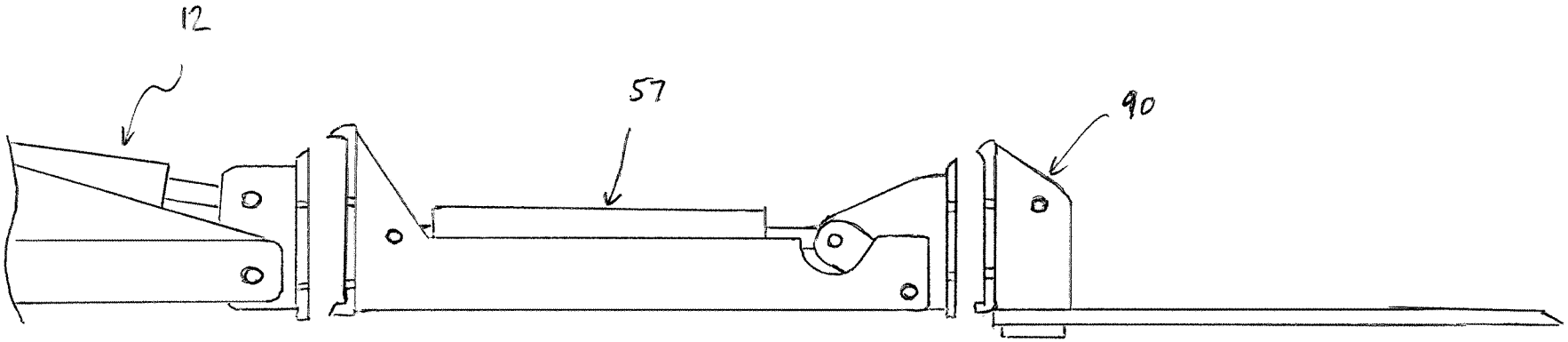
FIG. 18 is an elevational view of another configuration of the arrangement of attachment of FIG. 1.
Figure 19:
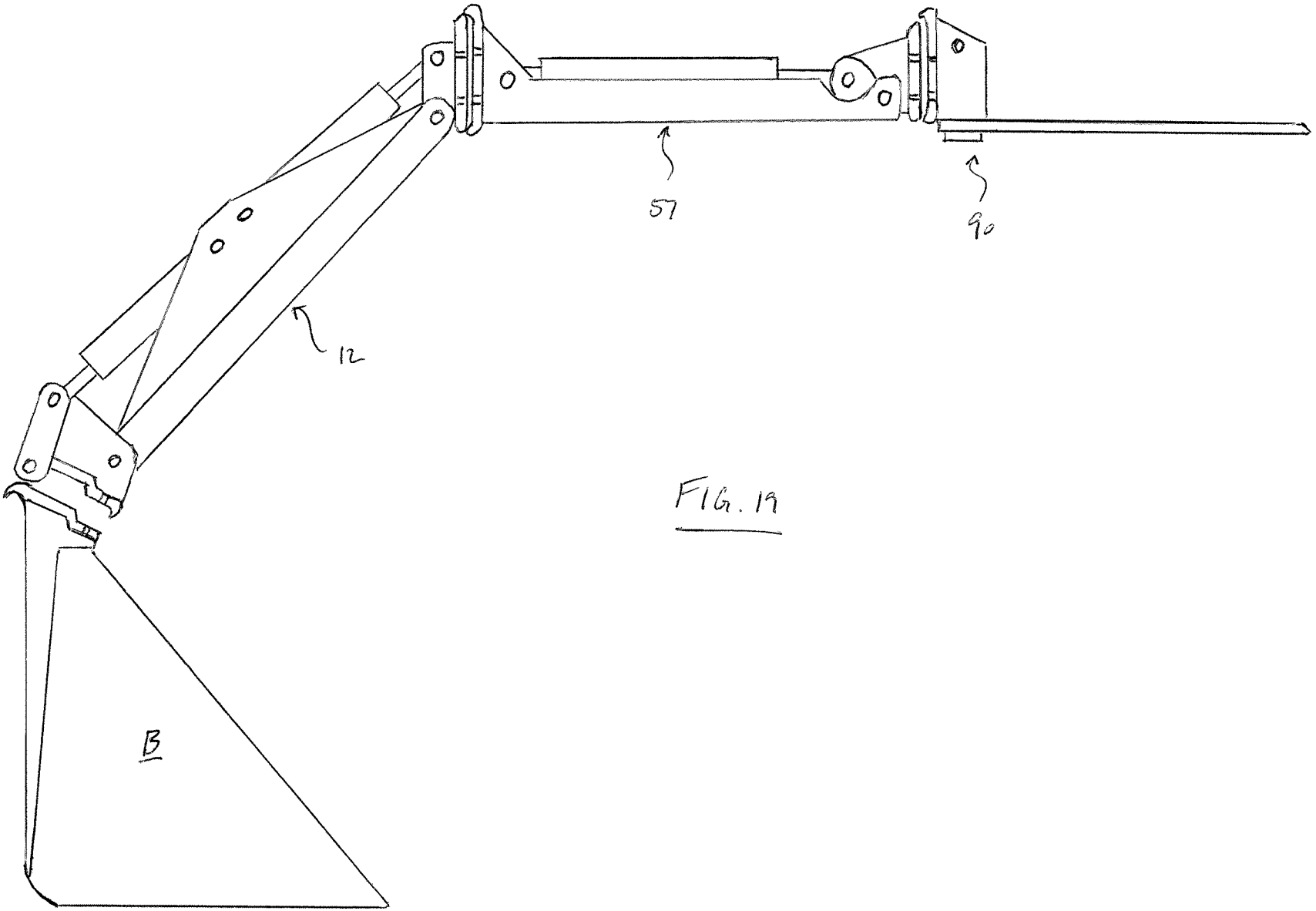
FIG. 19 is an elevational view of the configuration of FIG. 18 arranged in a different position relative to the bucket.
Figure 20:
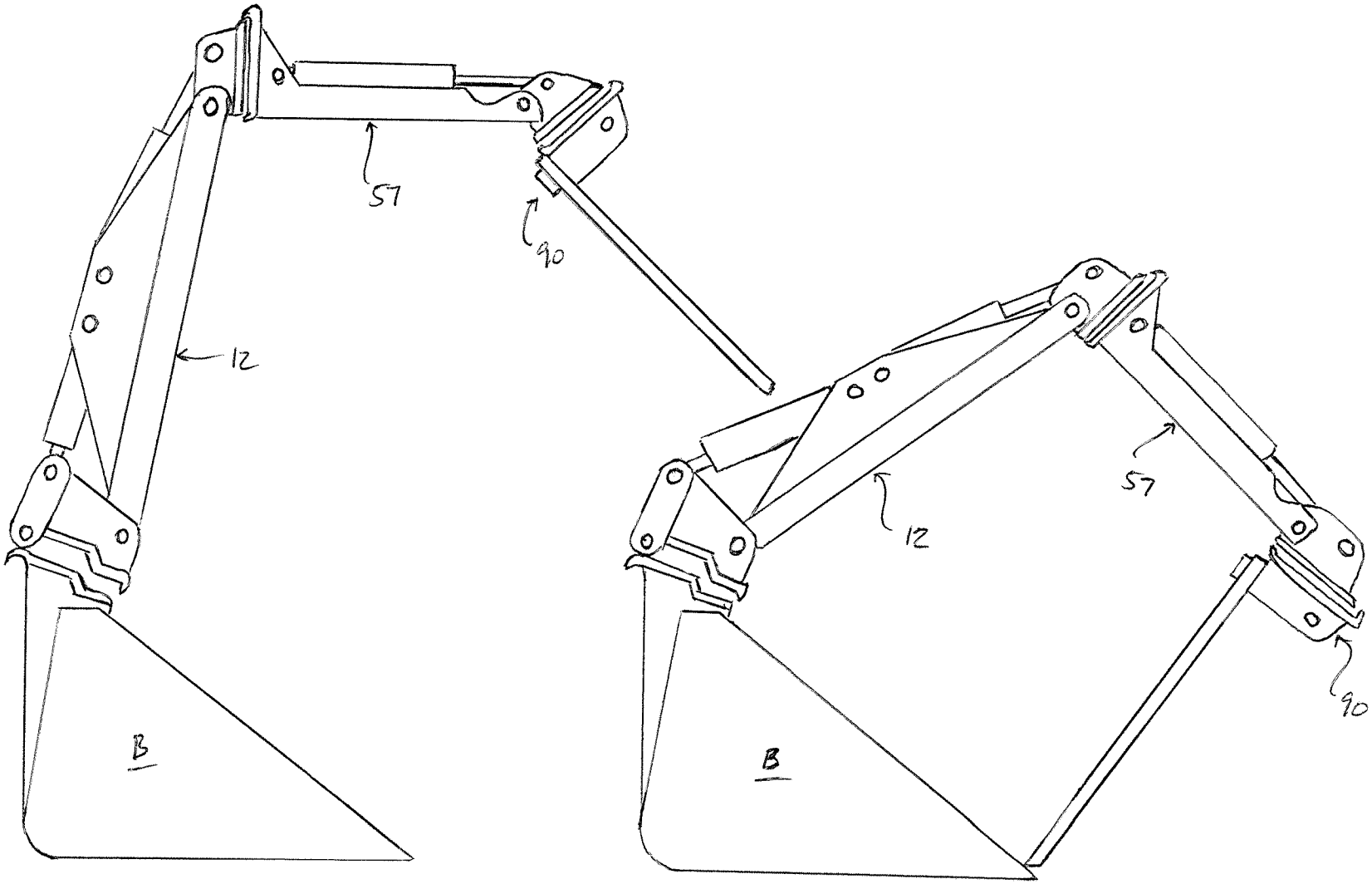
FIG. 20 is an elevational view of the configuration of FIG. 18 arranged in a yet different position relative to the bucket.
Figure 21:
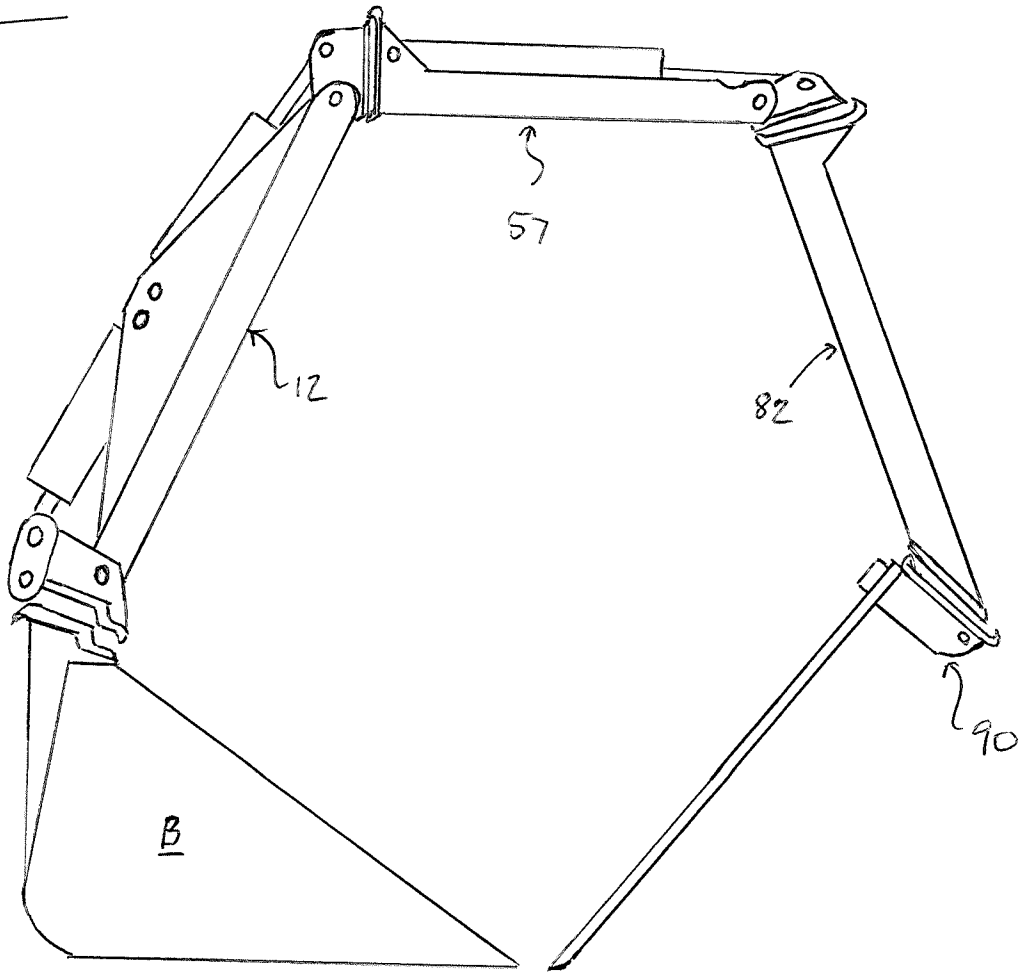
FIG. 21 is an elevational view of a further configuration of the arrangement of attachment of FIG. 1.
Figure 22:
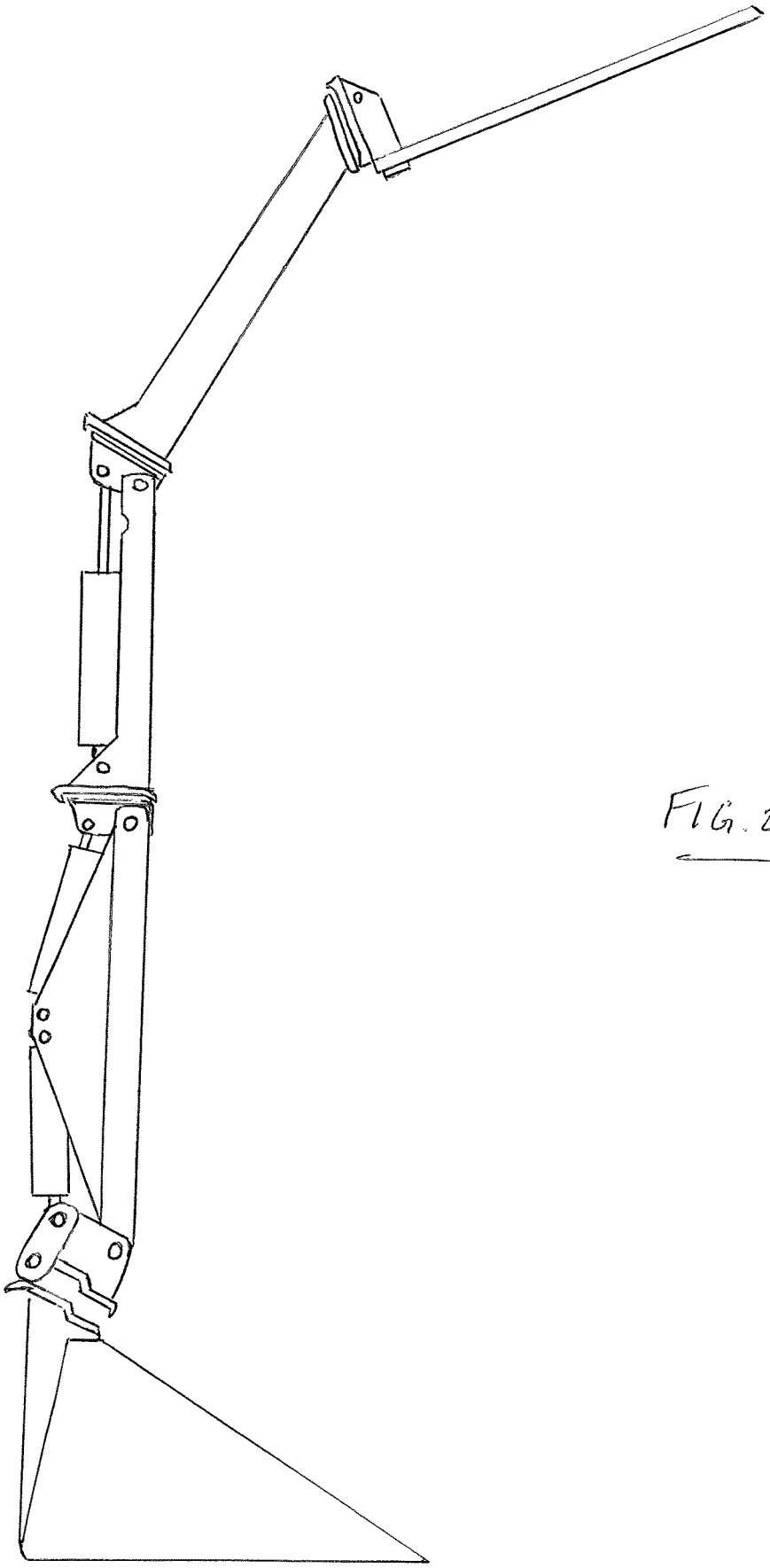
FIG. 22 is an elevational view of the configuration of FIG. 21 arranged in a different position relative to the bucket.

FIGS. 15-22 illustrate various configurations of the attachment 10 each showing connected to the base arm section various other ones of the arm sections described hereinbefore. In FIGS. 15-17 the attachment comprises the base arm section 12 and the tool section 90. In FIGS. 18-20 the attachment comprises the base arm section 12, the secondary arm section 57 connected thereto, and the tool section 90 connected to the distal end of the secondary arm section 57. In FIGS. 21-22 the attachment comprises the base arm section 12, the secondary arm section 57 connected thereto, the extension arm section 82 connected to the distal end of the secondary arm section 57, and the tool section 90 connected to the distal end of the extension arm section 82.

It will be appreciated that each configuration of the attachment 10 provides a different range of movement of the free end of the attachment 10 relative to the bucket B, both in regard to distance therefrom and angular ranges of movement relative to each pivotal joint.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An attachment in combination with a bucket of a prime mover for carrying ground material;

the prime mover having a frame which is arranged for movement across a support surface in a forward working direction;

the bucket having a bottom wall with a cutting edge, a rear wall defining a top edge which is opposite the cutting edge, and opposite side walls defining edges adjacent to the top and cutting edges and spanning therebetween, collectively defining an opening of the bucket through which the ground material is passed into the bucket;

the bucket being supported generally at one end of the frame for pivotal movement relative to the frame about a bucket axis which is transversely oriented to the forward working direction;

the attachment comprising:

a base member having fixed shape in a longitudinal direction of the base member between first and second ends;

first and second pivoting members respectively pivotally connected at a different one of the first and second ends of the base member for pivotal movement relative thereto;

each of the first and second pivoting members being pivotally movable about an axis which is transverse relative to the longitudinal direction of the base member;

the first pivoting member being mounted to the bucket adjacent the top edge of the bucket with the axis of the first pivoting member disposed generally parallel to the bucket axis at a spaced location therefrom such that the base member is pivotally movable relative to the bucket about the axis of the first pivoting member which is distinct from the bucket axis;

first and second linear actuators, each of which is operable for extension and retraction between opposite ends, respectively operatively interconnected between the base member and a different one of the first and second pivoting members for actuating the pivotal movement thereof relative to the base member;

each of the first and second linear actuators being connected at a first one of the opposite ends thereof to said different one of the first and second pivoting members and at a second one of the opposite ends to the base member at a longitudinally spaced location from said different one of the first and second ends of the base member at which said different one of the first and second pivoting members is pivotally connected; and at least one prong supported by the second pivoting member, each prong having a free end distal to the second pivoting member;

wherein the base member is arranged to span from the top edge to the cutting edge of the bucket such that the second pivoting member can be located at the cutting edge.

2. The attachment according to claim 1 wherein the base member extends linearly from the first end thereof to the second end.

3. The attachment according to claim 1 wherein the first and second linear actuators comprise hydraulic cylinders which are mounted on top of the base member so as to be opposite the bucket.

4. The attachment according to claim 3 wherein rod ends of the hydraulic cylinders are pivotally connected to the first and second pivoting members and base ends of the hydraulic cylinders are operatively connected to the base member.

5. The attachment according to claim 1 wherein the first and second linear actuators are disposed end to end on the base member such that the second ends of the linear actuators are connected at intermediate locations along the base member.

6. The attachment according to claim 1 wherein the second pivoting member forms a base for releasably receiving said at least one prong and different attachment ends.

7. The attachment according to claim 6 wherein one of the different attachment ends comprises a secondary member with a connector end which is configured for connecting to the second pivoting member that is pivotally supported on the base member, the secondary member having fixed shape and comprising:

a respective pivoting member carried on the secondary member opposite the connector end; and an actuator carried on the secondary member that is operatively connected to the respective pivoting member for actuating the pivotal movement thereof.

8. The attachment according to claim 6 wherein one of the different attachment ends comprises an extension member having a first end configured for connecting to the second pivoting member that is pivotally supported on the base member and an opposite second end which forms a base for releasably receiving another one of the attachment ends in distal relation to the base member, the extension member extending linearly between the first and second ends thereof along a longitudinal direction of the extension member, each of the first and second ends of the extension member defining a planar mating surface which is transverse to the longitudinal direction of the extension member, the planar mating surface of the first end of the extension member being oriented substantially normal to the longitudinal direction of the extension member and the planar mating surface of the second end of the extension member being oriented non-perpendicular to the longitudinal direction of the extension member so as to position said another one of the attachment ends which is connected to the end of the extension member transversely to the longitudinal direction of the extension member.

9. The attachment according to claim 6 wherein one of the different attachment ends comprises a tool member having a connector portion configured for connecting to the second pivoting member that is pivotally supported on the base member, and a working portion forming a fork, the working portion comprising a pair of first prongs fixedly projecting in a longitudinal direction of the attachment end from a common side of the connector portion at transversely spaced locations thereon and a second prong pivotally mounted to the connector portion transversely intermediate the first prongs so as to define a pivot axis transversely oriented to the longitudinal direction of the attachment end for pivotal movement of the second prong relative to the first prongs, the second prong being operatively connected to an actuator which is operable to displace the second prong in the pivotal movement relative to the first prongs which are stationary relative to the connector portion.

10. An attachment in combination with a bucket of a prime mover for carrying ground material;

the prime mover having a frame which is arranged for movement across a support surface in a forward working direction;

the bucket having a bottom wall with a cutting edge, a rear wall defining a top edge which is opposite the cutting edge, and opposite side walls defining edges adjacent to the top and cutting edges and spanning therebetween, collectively defining an opening of the bucket through which the ground material is passed into the bucket;

the bucket being supported generally at one end of the frame for pivotal movement relative to the frame about a bucket axis which is transversely oriented to the forward working direction;

the attachment comprising:

a base member having fixed shape in a longitudinal direction of the base member between first and second ends;

first and second pivoting members respectively pivotally connected at a different one of the first and second ends of the base member for pivotal movement relative thereto;

each of the first and second pivoting members being pivotally movable about an axis which is transverse relative to the longitudinal direction of the base member;

the first pivoting member being mounted to the bucket adjacent the top edge of the bucket with the axis of the first pivoting member disposed generally parallel to the bucket axis at a spaced location therefrom such that the base member is pivotally movable relative to the bucket about the axis of the first pivoting member which is distinct from the bucket axis;

first and second actuators operatively interconnected between the base member and a different one of the first and second pivoting members for actuating the pivotal movement thereof;

wherein the second pivoting member forms a base for releasably receiving different attachment ends; and wherein one of the different attachment ends comprises an extension member having a first end configured for connecting to the second pivoting member that is pivotally supported on the base member and an opposite second end which forms a base for releasably receiving another one of the attachment ends in distal relation to the base member, the extension member extending linearly between the first and second ends thereof along a longitudinal direction of the extension member, each of the first and second ends of the extension member defining a planar mating surface which is transverse to the longitudinal direction of the extension member, the planar mating surface of the first end of the extension member being oriented substantially normal to the longitudinal direction of the extension member and the planar mating surface of the second end of the extension member being oriented non-perpendicular to the longitudinal direction of the extension member so as to position said another one of the attachment ends which is connected to the end of the extension member transversely to the longitudinal direction of the extension member.

* * * * *